US011014353B2

(12) United States Patent
Kiji

(10) Patent No.: US 11,014,353 B2
(45) Date of Patent: May 25, 2021

(54) INK JET HEAD AND INK JET RECORDING APPARATUS

(71) Applicant: TOSHIBA TEC KABUSHIKI KAISHA, Tokyo (JP)

(72) Inventor: Yasuhito Kiji, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 8 days.

(21) Appl. No.: 16/550,507

(22) Filed: Aug. 26, 2019

(65) Prior Publication Data

US 2020/0189271 A1 Jun. 18, 2020

(30) Foreign Application Priority Data

Dec. 14, 2018 (JP) ..... JP2018-234394

(51) Int. Cl.
*B41J 2/045* (2006.01)
*B41J 2/14* (2006.01)

(52) U.S. Cl.
CPC ..... *B41J 2/04588* (2013.01); *B41J 2/04581* (2013.01); *B41J 2/14233* (2013.01)

(58) Field of Classification Search
CPC ..... B41J 2/04581; B41J 2/04588; B41J 2/04596; B41J 2/04541; B41J 2/14233
See application file for complete search history.

(56) References Cited

U.S. PATENT DOCUMENTS

2003/0085962 A1 5/2003 Junhua
2006/0125856 A1 6/2006 Kitami et al.
2012/0218333 A1 8/2012 Nishikawa
2012/0306954 A1 12/2012 Nishikawa
2016/0031214 A1* 2/2016 Okui ..... B41J 2/14233 347/50

FOREIGN PATENT DOCUMENTS

EP 3238941 11/2017
JP 2012-045797 3/2012

OTHER PUBLICATIONS

Extended European Search Report for European Patent Application No. 19198687.6 dated Apr. 30, 2020.

* cited by examiner

*Primary Examiner* — Jannelle M Lebron
(74) *Attorney, Agent, or Firm* — Amin, Turocy & Watson, LLP

(57) ABSTRACT

An ink jet head includes a pressure chamber, an actuator, and an application unit. The chamber accommodates liquid. The actuator changes a volume of the chamber with a drive signal to be applied. The unit apply s the signal to the actuator. The signal includes a discharge pulse and a vibration pulse. The discharge pulse causes liquid to be discharged from a nozzle. A second discharge pulse is applied after a first discharge pulse. The vibration pulse is applied before the discharge pulse, has a potential having a polarity opposite to that of the discharge pulse. A period of the discharge pulse is 1.5 times to 2.5 times a half-period of a main acoustic resonance frequency of liquid in the chamber. A pulse width of the first pulse is closer to the half-period of the main acoustic resonance frequency than a pulse width of the second pulse.

18 Claims, 12 Drawing Sheets

A–A

INK JET HEAD AND INK JET RECORDING APPARATUS

CROSS-REFERENCE TO RELATED APPLICATION

This application is based upon and claims the benefit of priority from Japanese Patent Application No. 2018-234394, filed Dec. 14, 2018, the entire contents of which are incorporated herein by reference.

FIELD

Embodiments described herein relate generally to an ink jet head, an ink jet recording apparatus, and methods related thereto.

BACKGROUND

A multi-drop ink jet head discharges a plurality of ink droplets per dot to adjust the amount of droplets. A driving device of this ink jet head includes a drive circuit that controls the discharge of droplets. The drive circuit outputs a high-frequency drive signal to an actuator included in the ink jet head to control the discharge of droplets.

DETAILED DESCRIPTION

Figure 1:
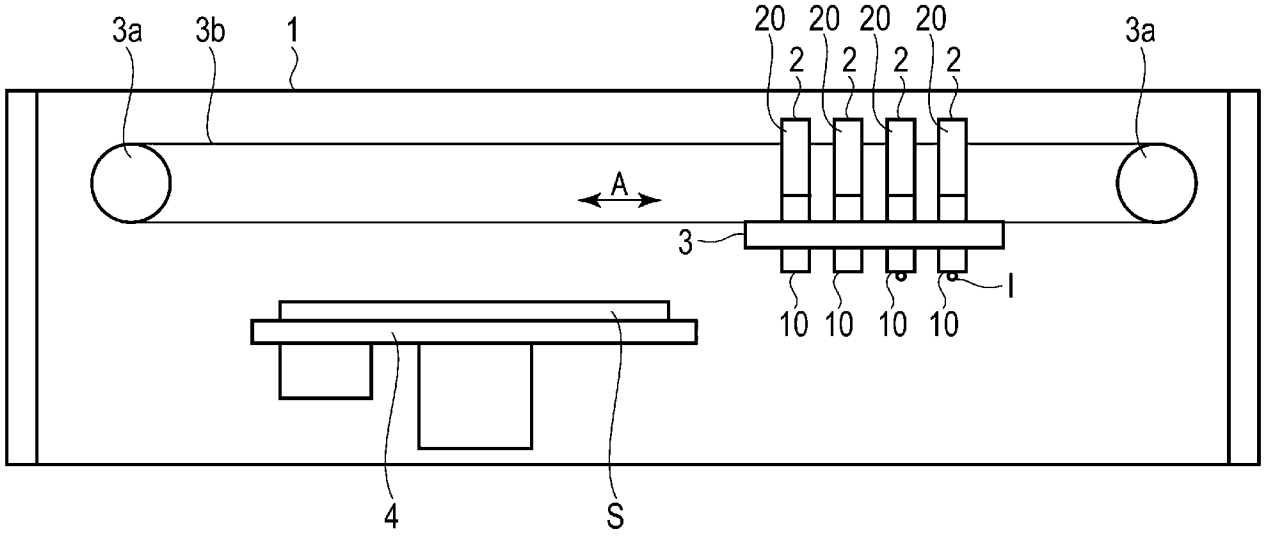
FIG. 1 is a schematic diagram illustrating an example of a configuration of an inkjet recording apparatus according a first embodiment and a second embodiment.

Embodiments provide an ink jet head having low power consumption at a low cost and an ink jet recording apparatus.

In general, according to one embodiment, an ink jet head includes a pressure chamber, an actuator, and an application unit. The pressure chamber accommodates liquid. The actuator is configured to change a volume of the pressure chamber in accordance with a drive signal to be applied. The application unit is configured to apply the drive signal to the actuator. The drive signal includes a first discharge pulse, a second discharge pulse, and a vibration pulse. The first discharge pulse causes liquid to be discharged from a nozzle communicating with the pressure chamber. The second discharge pulse is applied after the first discharge pulse and causes liquid to be discharged from a nozzle communicating with the pressure chamber. The vibration pulse is applied before the first discharge pulse, has a potential having a polarity opposite to that of the first discharge pulse and the second discharge pulse, and causes pressure vibration to be generated in liquid to promote discharge of the liquid. A period of the first discharge pulse and the second discharge pulse is 1.5 times to 2.5 times a half-period of a main acoustic resonance frequency of liquid in the pressure chamber. A pulse width of the first discharge pulse is closer to the half-period of the main acoustic resonance frequency than a pulse width of the second discharge pulse.

Hereinafter, an exemplary embodiment will be described with reference to the drawings. In the drawings, the same or identical portions will be represented by the same reference numerals. In addition, in each of the drawings used for the description of the embodiment, the scale of each of components may be appropriately changed.

First Embodiment

FIG. 1 is a schematic diagram illustrating an example of a configuration of an ink jet recording apparatus 1 including an ink jet head according to an embodiment.

The ink jet recording apparatus 1 forms an image on an image forming medium S or the like using a liquid recording material such as ink. For example, the ink jet recording apparatus 1 includes: a plurality of liquid discharging units 2; a head support mechanism 3 that movably supports the liquid discharging units 2; and a medium support mechanism 4 that movably supports the image forming medium S. The image forming medium S is, for example, sheet-like paper.

As illustrated in FIG. 1, the liquid discharging units 2 are supported by the head support mechanism 3 in a state where they are arranged in parallel in a predetermined direction. The head support mechanism 3 is attached to a belt 3*b* that is supported by a roller 3*a*. The ink jet recording apparatus 1 can move the head support mechanism 3 in a main scanning direction A perpendicular to a conveying direction of the image forming medium S by rotating the roller 3*a*. The liquid discharging unit 2 includes an ink jet head 10 and an ink supply device 20 that are integrated. The liquid discharging unit 2 executes a discharge operation of discharging liquid I such as ink from the ink jet head 10. The ink jet recording apparatus 1 is, for example, a scanning type that forms a desired image on the image forming medium S arranged to face the head support mechanism 3 by executing the ink discharge operation while reciprocating the head support mechanism 3 in the main scanning direction A. Alternatively, the ink jet recording apparatus 1 may be a single-pass type that executes the ink discharge operation without moving the head support mechanism 3. In this case, the roller 3*a* and the belt 3*b* are not provided. In addition, in this case, the head support mechanism 3 is fixed to, for example, a case of the ink jet recording apparatus 1. Further, in this case, the conveying direction of the image forming medium S is an A direction.

Each of the liquid discharging units 2 corresponds to any one of four color inks of CMYK (cyan, magenta, yellow, and key (black). That is, each of the liquid discharging units 2 corresponds to any one of cyan ink, magenta ink, yellow ink, or black ink. Each of the liquid discharging units 2 discharges the corresponding color ink. The liquid discharging unit 2 can continuously discharge one droplet or a plurality of droplets of the corresponding color ink to one pixel of the image forming medium S. As the number of times the ink is discharged to one pixel increases, the amount of droplets landed on the pixel increases. Accordingly, as the number of times the ink is discharged to one pixel increases, the corresponding color in the pixel looks deep. As a result, the ink jet recording apparatus 1 can express the gradation of the image formed on the image forming medium S.

Figure 2:
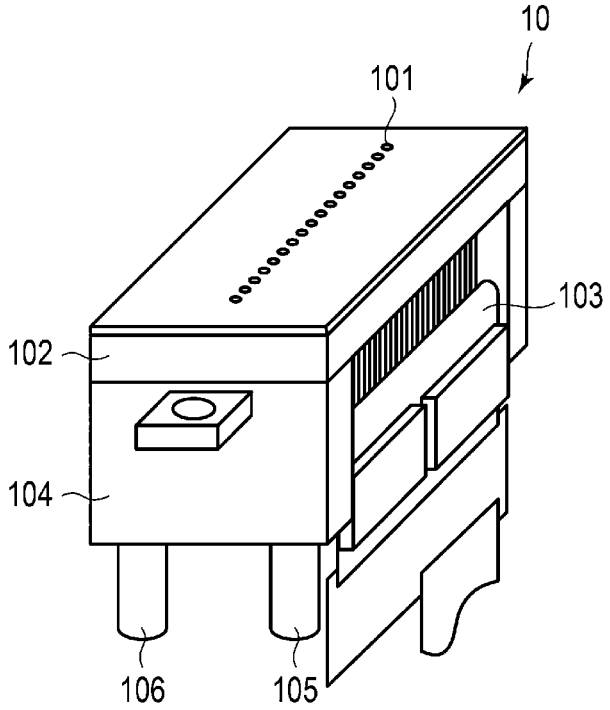
FIG. 2 is a perspective view illustrating an example of the ink jet head illustrated in FIG. 1.

FIG. 2 is a perspective view illustrating an example of the ink jet head 10. The ink jet head 10 includes nozzles 101, a head substrate 102, a drive circuit 103, and a manifold 104. The manifold 104 includes an ink supply port 105 and an ink discharge port 106.

The nozzles 101 are provided on the head substrate 102. The nozzles 101 are arranged in a row along a longitudinal direction of the head substrate 102. The drive circuit 103 is a drive signal output unit that outputs a drive signal for discharging ink droplets from the nozzles 101. The drive circuit 103 is, for example, a driver IC (integrated circuit). The drive circuit 103 generates the drive signal, for example, based on waveform data. The ink supply port 105 is a supply port for supplying ink to the nozzles 101. In addition, the ink discharge port 106 is a discharge port of ink. The nozzles 101 discharge ink droplets supplied from the ink supply port 105 in accordance with the drive signal applied from the drive circuit 103. Ink that is not discharged from the nozzles 101 is discharged from the ink discharge port 106.

The drive circuit 103 is an example of the application unit.

Figure 3:
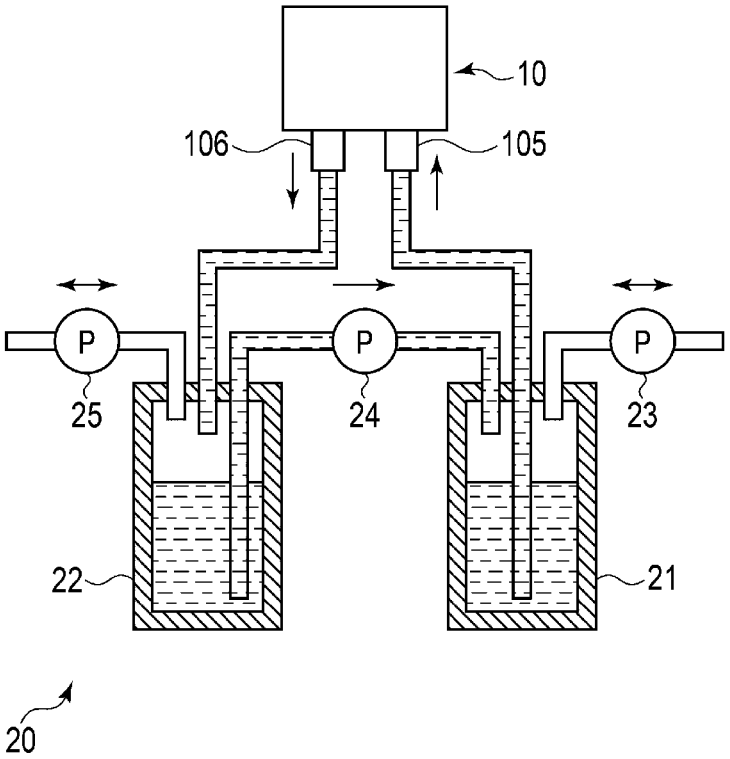
FIG. 3 is a schematic diagram illustrating an ink supply device illustrated in FIG. 1.

FIG. 3 is a schematic diagram of the ink supply device 20 used in the ink jet recording apparatus 1. The ink supply device 20 is a device that supplies ink to the ink jet head 10. The ink supply device 20 includes a supply-side ink tank 21, a discharge-side ink tank 22, a supply-side pressure regulating pump 23, a conveying pump 24, and a discharge-side pressure regulating pump 25. These components are connected to each other through a tube through which ink can flow. The supply-side ink tank 21 is connected to the ink supply port 105 through the tube, and the discharge-side ink tank 22 is connected to the ink discharge port 106 through the tube.

The supply-side pressure regulating pump 23 regulates a pressure of the supply-side ink tank 21. The discharge-side pressure regulating pump 25 regulates a pressure of the discharge-side ink tank 22. The supply-side ink tank 21 supplies ink to the ink supply port 105 of the ink jet head 10. The discharge-side ink tank 22 temporarily stores ink discharged from the ink discharge port 106 of the ink jet head 10. The conveying pump 24 circulates the ink stored in the discharge-side ink tank 22 to the supply-side ink tank 21 through the tube.

Next, the ink jet head 10 will be described in more detail.

Figure 4:
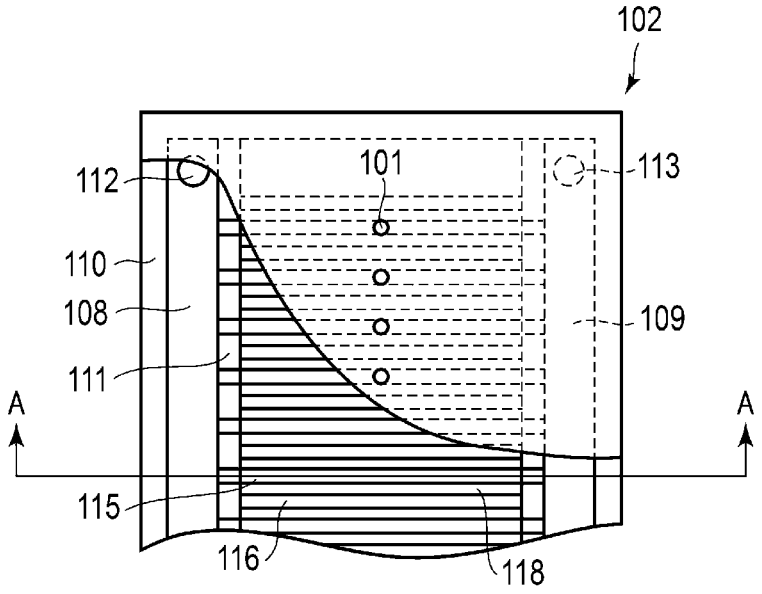
FIG. 4 is a plan view illustrating a head substrate that is applicable to the ink jet head illustrated in FIG. 1.
Figure 5:
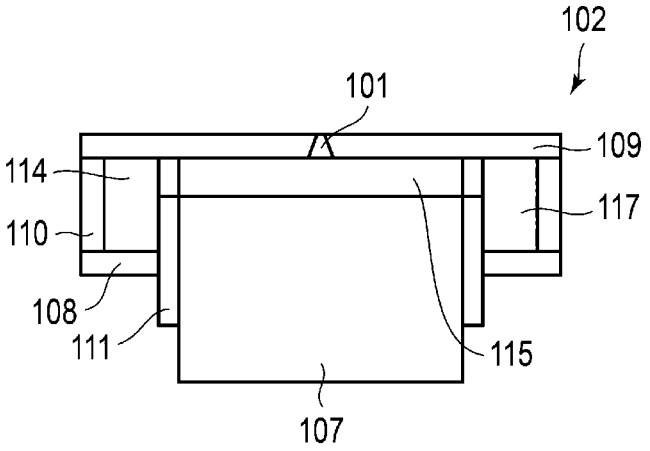
FIG. 5 is a cross-sectional view taken along line A-A of the head substrate illustrated in FIG. 4.
Figure 6:
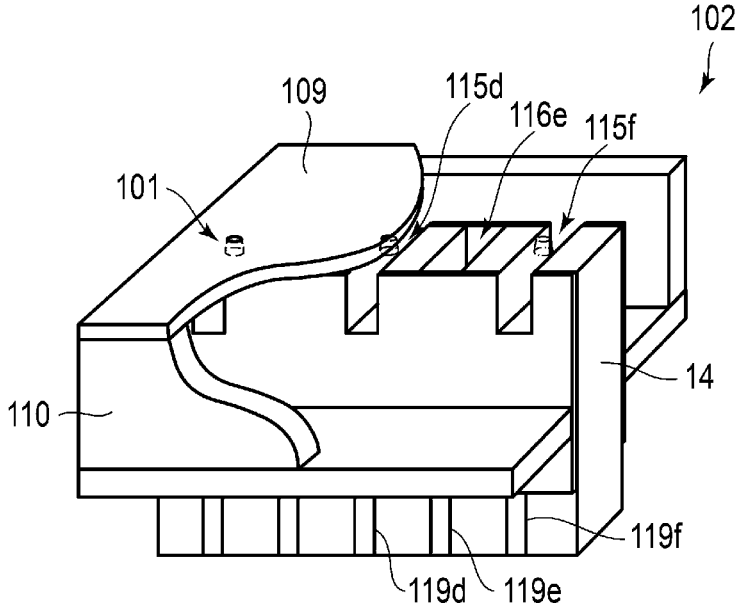
FIG. 6 is a perspective view illustrating the head substrate illustrated in FIG. 4.

FIG. 4 is a plan view illustrating the head substrate 102 that is applicable to the ink jet head 10. In FIG. 4, a part of nozzle plate 109 on the lower left side in the drawing is not illustrated, and an internal structure of the head substrate 102 is illustrated. FIG. 5 is a cross-sectional view taken along line A-A of the head substrate 102 illustrated in FIG. 4. FIG. 6 is a perspective view illustrating the head substrate 102 illustrated in FIG. 4.

As illustrated in FIGS. 4 and 5, the head substrate 102 includes a piezoelectric member 107, an ink flow path member 108, the nozzle plate 109, a frame member 110, and a partition wall 111. In addition, in the ink flow path member 108, an ink supply hole 112 and an ink discharge hole 113 are formed. A space that is surrounded by the ink flow path member 108, the nozzle plate 109, the frame member 110, and the partition wall 111 and where the ink supply hole 112 is formed is an ink supply path 114. In addition, a space that is surrounded by the ink flow path member 108, the nozzle plate 109, the frame member 110, and the partition wall 111 and where the ink discharge hole 113 is formed is an ink discharge path 117. The ink supply hole 112 communicates with the ink supply path 114. The ink discharge hole 113 communicates with the ink discharge path 117. The ink supply hole 112 is fluidically connected to the ink supply port 105 of the manifold 104. The ink discharge hole 113 is fluidically connected to the ink discharge port 106 of the manifold 104.

The piezoelectric member 107 includes a plurality of long slots that extend from the ink supply path 114 to the ink discharge path 117. These long slots form a part of the pressure chamber 115 or an air chamber 116. The pressure chamber 115 and the air chamber 116 are alternately formed. That is, in the piezoelectric member 107, the pressure chamber 115 and the air chamber 116 are alternately formed. The air chamber 116 is formed by blocking opposite ends of the long slot with the partition wall 111. By blocking opposite ends of the long slot with the partition wall 111, ink of the ink supply path 114 and the ink discharge path 117 is prevented from flowing into the air chamber 116. A slot is formed in a portion of the partition wall 111 in contact with the pressure chamber 115. As a result, ink flows from the ink supply path 114 to the pressure chamber 115 and is discharged from the pressure chamber 115 to the ink discharge path 117.

In the piezoelectric member 107, as illustrated in FIGS. 6 to 9, wiring electrodes 119 (119*a*, 119*b*, . . . , 119*g*, . . . ) are formed. On a piezoelectric member inner surface between the pressure chamber 115 and the air chamber 116, an electrode 120 described below is formed. The wiring electrode 119 electrically connects the electrode 120 and the drive circuit 103 to each other. It is preferable that the ink flow path member 108, the frame member 110, and the partition wall 111 are formed of, for example, a material having a low dielectric constant and a small difference in thermal expansion coefficient from the piezoelectric member. As the material, for example, alumina ($Al_2O_3$), silicon nitride ($Si_3N_4$), silicon carbide (SiC), aluminum nitride (AlN), or lead zirconate titanate (PZT) can be used. In the embodiment, the ink flow path member 108, the frame member 110, and the partition wall 111 are formed of alumina ($Al_2O_3$).

Figure 7:
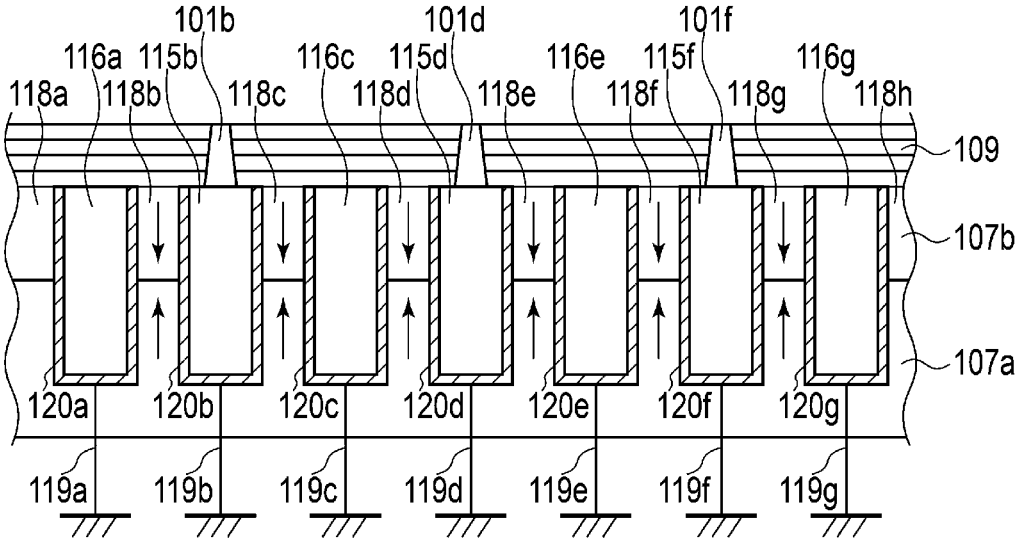
FIG. 7 is a diagram illustrating a state of a pressure chamber.
Figure 8:
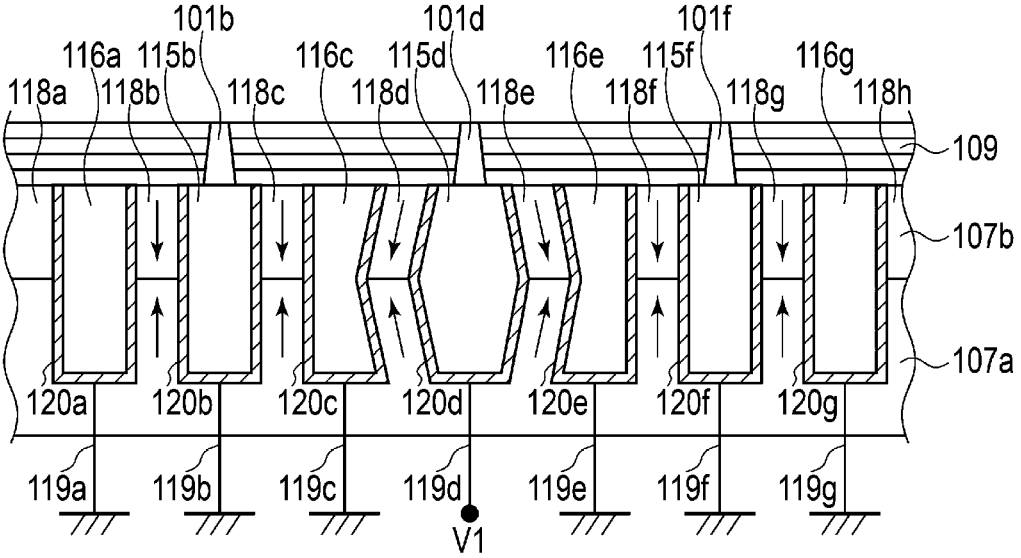
FIG. 8 is a diagram illustrating a state where one pressure chamber is expanded.
Figure 9:
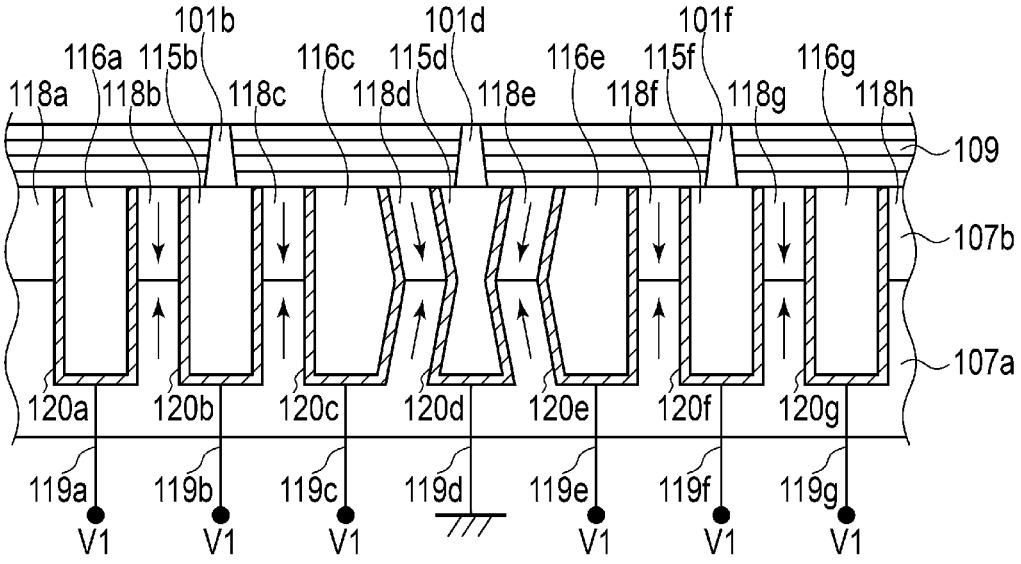
FIG. 9 is a diagram illustrating a state where one pressure chamber is contracted.

As illustrated in FIGS. 7 to 9, the piezoelectric member 107 is formed by laminating a piezoelectric member 107*a* and a piezoelectric member 107*b*. FIGS. 7 to 9 are diagrams illustrating states of the pressure chamber. Polarization directions of the piezoelectric member 107*a* and the piezoelectric member 107*b* are opposite to each other along a thickness direction. In the piezoelectric member 107, a plurality of long slots that extend from the ink supply path 114 to the ink discharge path 117 are formed in parallel.

On an inner surface of each of the long slots, the electrode 120 (120*a*, 120*b*, . . . , 120*g*, . . . ) is formed. A space that is surrounded by the long slot and one surface of the nozzle plate 109 covering the long slot form the pressure chamber 115 and the air chamber 116. In an example illustrated in FIG. 7, each of spaces represented by 115*b*, 115*d*, 115*f*, . . . is the pressure chamber 115, and each of spaces represented by 116*a*, 116*c*, 116*e*, 116*g*, . . . is the air chamber 116.

As described above, the pressure chamber 115 and the air chamber 116 are alternately arranged. The electrode 120 is connected to the drive circuit 103 through the wiring electrode 119. The piezoelectric member 107 forming a partition wall of the pressure chamber 115 is interposed between the electrodes 120 provided on the inner surfaces of the respective long slots. The piezoelectric member 107 and the electrode 120 constitute an actuator 118.

The drive circuit 103 applies an electric field to the actuator 118 in accordance with the drive signal. Due to the applied electric field, the actuator 118 undergoes shearing deformation like actuators 118*d* and 118*e* of FIG. 8 in a state where a junction portion between the piezoelectric member 107*a* and the piezoelectric member 107*b* is a top portion. The actuator 118 is deformed such that the volume of the pressure chamber 115 changes. Due to the change in the volume of the pressure chamber 115, ink present in the pressure chamber 115 is pressurized or depressurized. Due to the pressurization or depressurization, ink is discharged from the nozzles 101. As the piezoelectric member 107, for example, lead zirconate titanate (PZT: $Pb(Zr,Ti)O_3$), lithium niobate ($LiNbO_3$), or lithium tantalate ($LiTaO_3$) can be used. In the embodiment, as the piezoelectric member 107, lead zirconate titanate (PZT) having a high piezoelectric constant is used.

The electrode 120 has, for example, a two-layer structure including nickel (Ni) and gold (Au). The electrode 120 is uniformly formed in the long slot, for example, using a plating method. As a method of forming the electrode 120, a sputtering method or a vapor deposition method can be used in addition to a plating method. For example, the long slots have a shape having a length of 1.5 to 2.5 mm in a longitudinal direction, a depth of 150.0 to 300.0 μm, and a width of 30.0 to 110.0 μm and are arranged in parallel at a pitch of 70 to 180 μm. As described above, the long slot forms a part of the pressure chamber 115 or the air chamber 116. The pressure chamber 115 and the air chamber 116 are alternately arranged.

The nozzle plate 109 is bonded to the piezoelectric member 107. The nozzles 101 are formed at the center of the nozzle plate 109 in a longitudinal direction of the pressure chamber 115. The material of the nozzle plate 109 is, for example, a metal material such as stainless steel, an inorganic material such as single-crystal silicon, or a resin material such as a polyimide film. In the embodiment, for example, the material of the nozzle plate 109 is a polyimide film.

In the ink jet head 10, the ink supply path 114 is provided at one end of the pressure chamber 115, the ink discharge path 117 is provided at another end of the pressure chamber 115, and the nozzles 101 are provided at the center of the pressure chamber 115. The ink jet head 10 is not limited to this configuration example. For example, in the ink jet head, the nozzles may be provided at one end of the pressure chamber 115, and the ink supply path may be provided at another end of the pressure chamber 115.

Next, the operation principle of the ink jet head 10 according to the embodiment will be described.

FIG. 7 illustrates the head substrate 102 in a state where a ground voltage is applied to the electrodes 120*a* to 120*g* through the wiring electrodes 119*a* to 119*g*. In FIG. 7, since the electrodes 120*a* to 120*g* have the same potential, an electric field is not applied to actuators 118*a* to 118*h*. Therefore, the actuators 118*a* to 118*h* are not deformed.

FIG. 8 illustrates the head substrate 102 in a state where a voltage V1 is applied to only the electrode 120*d*. In the state illustrated in FIG. 8, a potential difference is generated between the electrode 120*d* and the electrodes 120*c* and 120*e* present at opposite ends of the electrode 120*d*. The actuators 118*d* and 118*e* undergo shearing deformation due to the applied potential difference such that the volume of the pressure chamber 115*d* is expanded. Here, when the voltage of the electrode 120*d* returns from V1 to the ground voltage, the actuators 118*d* and 118*e* return from the state of FIG. 8 to the state of FIG. 7. Therefore, droplets are discharged from the nozzle 101*d*.

In FIG. 9, the volume of the pressure chamber 115*d* is contracted. In FIG. 9, the actuators 118*d* and 118*e* are deformed in a shape opposite to the state illustrated in FIG. 8.

FIG. 9 illustrates the head substrate 102 in a state where the electrode 120*d* is grounded and the voltage V1 is applied to the electrodes 120*a*, 120*c*, 120*e*, and 120*g* of the air chambers 116*a*, 116*c*, 116*e*, and 116*g*. In the state illustrated in FIG. 9, a potential difference (electric field) opposite to that of FIG. 8 is generated between the electrode 120*d* and the electrodes 120*c* and 120*e* present at opposite ends of the electrode 120*d*. Due to the potential difference, the actuators 118*d* and 118*e* undergo shearing deformation in a shape opposite to that of FIG. 8. FIG. 9 illustrates a state where the voltage V1 is applied to the electrodes 120*b* and 120*f*. As a result, the actuators 118*b*, 118*c*, 118*f*, and 118*g* are not deformed. Unless the actuators 118*b*, 118*c*, 118*f*, and 118*g* are deformed, the pressure chambers 115*b* and 115*f* do not contract.

In the actuator 118*d*, the electrode 120*d* is an example of the first electrode. In the actuator 118*d*, the electrode 120*c* is an example of the second electrode. In the actuator 118*e*, the electrode 120*d* is an example of the first electrode. In the actuator 118*e*, the electrode 120*e* is an example of the second electrode. Each of the other actuators 118 also includes the first electrode and the second electrode.

Figure 10:
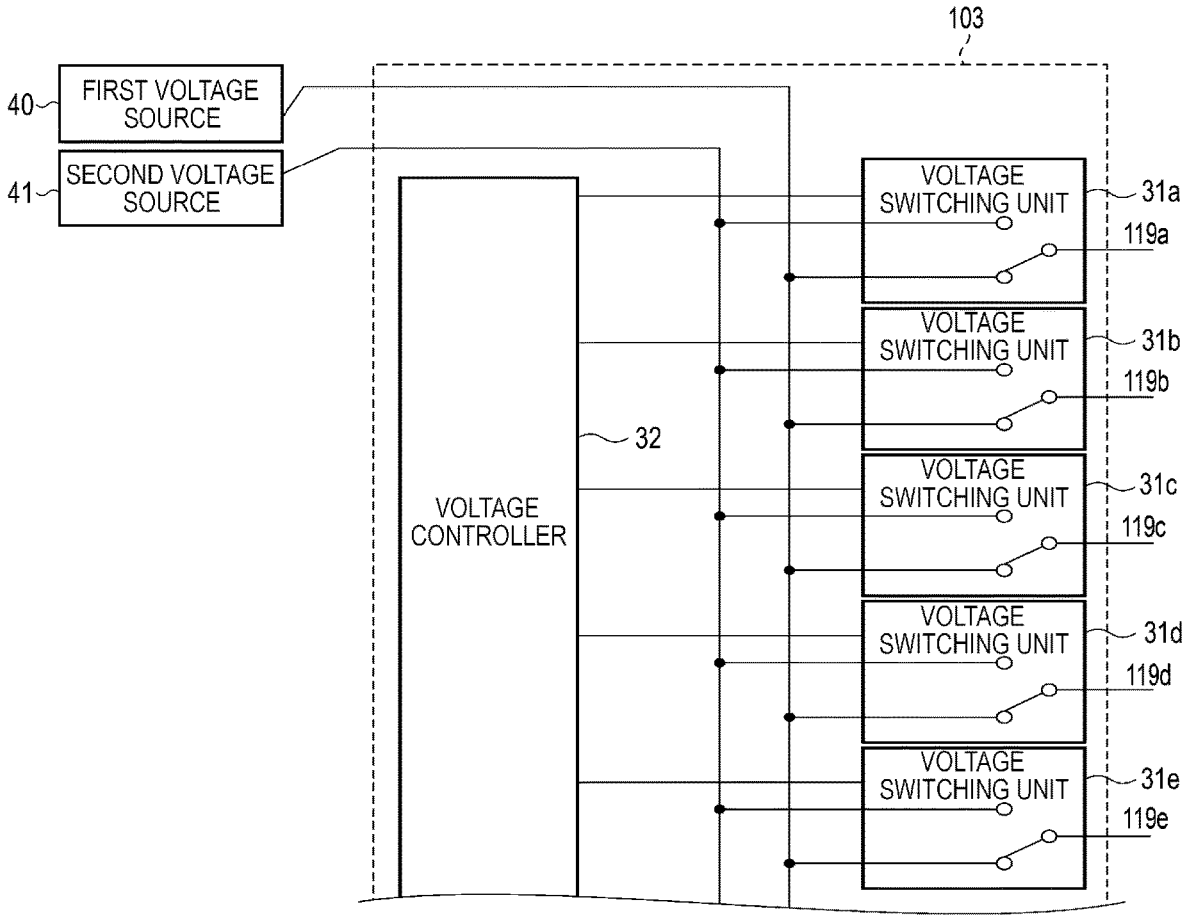
FIG. 10 is a diagram illustrating a configuration example of a drive circuit according to the first embodiment.

FIG. 10 is a diagram illustrating a configuration example of the drive circuit 103. The drive circuit 103 includes a number of voltage switching units 31 corresponding to the number of the pressure chambers 115 and the air chambers 116 in the ink jet head 10. In the configuration example illustrated in FIG. 10, voltage switching units 31*a*, 31*b*, . . . , and 31*e* are illustrated. In addition, the drive circuit 103 includes a voltage controller 32.

The drive circuit 103 is connected to a first voltage source 40 and a second voltage source 41. The drive circuit 103 selectively applies voltages supplied from the first voltage source 40 and the second voltage source 41 to the respective wiring electrodes 119. In the example illustrated in FIG. 10, the output voltage of the first voltage source 40 is a ground voltage, and the voltage value thereof is set as V0 (V0=0 [V]). In addition, the voltage value of the output voltage of the second voltage source 41 is set as V1. The voltage value V1 is a value higher than V0.

The voltage switching unit 31 is configured with, for example, a semiconductor switch. The voltage switching units 31*a*, 31*b*, . . . , and 31*e* are connected to the wiring electrodes 119*a*, 119*b*, . . . , and 119*e*, respectively. In addition, the voltage switching unit 31 is connected to the first voltage source 40 and the second voltage source 41 through a wiring drawn into the drive circuit 103. The voltage switching unit 31 includes a switching switch for switching between the voltage sources connected to the wiring electrode 119. The voltage switching unit 31 switches between the voltage sources connected to the wiring electrode 119 using the switch. For example, the voltage switching unit 31*a* connects any one of the first voltage source 40 or the second voltage source 41 and the wiring electrode 119*a* to each other using the switching switch.

The voltage controller 32 is connected to each of the voltage switching units 31*a*, 31*b*, . . . , and 31*e*. The voltage controller 32 outputs a command to each of the voltage switching units 31, the command indicating whether or not to select any one of the first voltage source 40 or the second voltage source 41. For example, the voltage controller 32 receives print data from the outside of the drive circuit 103 and determines a timing at which each of the voltage switching units 31 switches between the voltage sources. At the determined switching timing, the voltage controller 32 outputs the command indicating whether or not to select any one of the first voltage source 40 or the second voltage source 41 to the voltage switching unit 31. The voltage switching unit 31 switches between the voltage sources connected to the wiring electrode 119 in accordance with the command from the voltage controller 32.

The first voltage source 40 is an example of the first voltage source. In addition, the second voltage source 41 is an example of the second voltage source.

Figure 11:
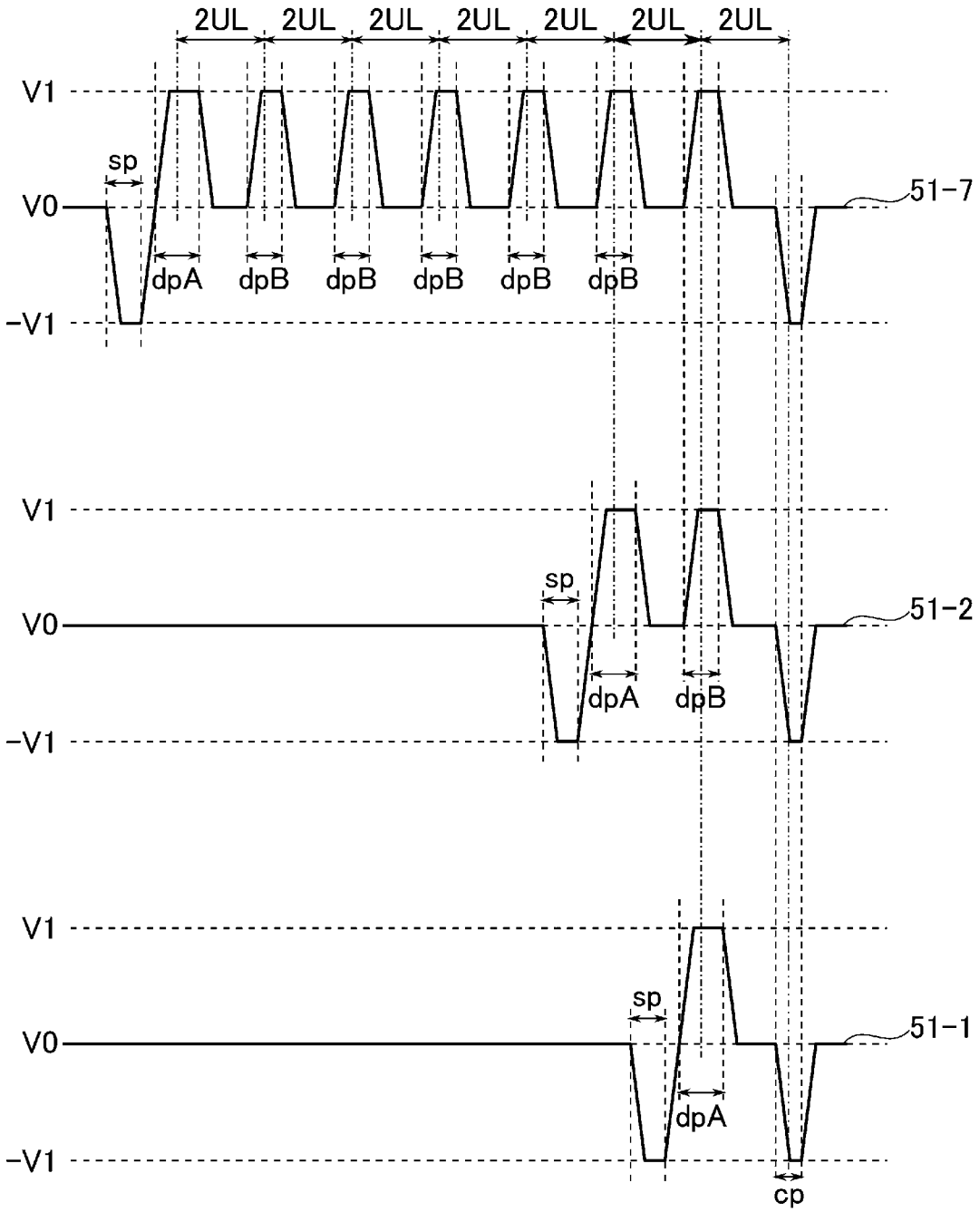
FIG. 11 is a diagram illustrating an example of a drive waveform according to the first embodiment.

FIG. 11 is a diagram illustrating a drive waveform example of the drive signal that is applied to the electrode 120 by the drive circuit 103. A drive waveform 51-7 is an example of a drive waveform of a case where seven droplets are continuously discharged. A drive waveform 51-2 is an example of a drive waveform of a case where two droplets are continuously discharged. A drive waveform 51-1 is an example of a drive waveform of a case where one droplet is continuously discharged. Drive waveforms 51-3 to 51-6 of cases where the numbers of droplets that are continuously discharged are 3 to 6 are not illustrated. The drive waveforms 51-1 to 51-7 will be collectively referred to as "drive waveform 51".

In FIG. 11, the horizontal axis represents the time, and the vertical axis represents a voltage. The voltage is a voltage of the electrode 120 to which the drive waveform 51 is applied. The voltage of the corresponding electrode 120 is a potential relative to the potentials of the wiring electrodes 119 connected to the electrodes 120 of inner walls of the air chambers 116 adjacent to the corresponding electrode 120. It is assumed that the drive waveform 51 illustrated in FIG. 11 is applied to the electrode 120*d* illustrated in FIG. 7. The air chambers 116 adjacent to the electrode 120*d* are the air chambers 116*c* and 116*e*. In addition, the electrodes of the inner walls of the air chambers 116*c* and 116*e* adjacent to the electrode 120*d* are the electrodes 120*c* and 120*e*, and the wiring electrodes connected to the electrodes 120*c* and 120*e* are the wiring electrodes 119*c* and 119*e*. Accordingly, when the drive waveform 51 is applied to the electrode 120*d*, the voltage illustrated in FIG. 11 is a potential of the electrode 120*d* relative to the potentials of the wiring electrodes 119*c* and 119*e* (the electrodes 120*c* and 120*e*).

When the voltage of the drive waveform 51 applied to the electrode 120*d* is 0, the pressure chamber 115*d* enters the state illustrated in FIG. 7 such that the volume does not change. In addition, when the voltage of the drive waveform 51 applied to the electrode 120*d* is V1, the pressure chamber 115*d* enters the state illustrated in FIG. 8 such that the volume expands. Further, when the voltage of the drive waveform 51 applied to the electrode 120*d* is −V1, the pressure chamber 115*d* enters the state illustrated in FIG. 9 such that the volume contracts.

The drive waveform 51 includes a vibration pulse, a discharge pulse, and a suppressing pulse in this order. The vibration pulse is applied to generate pressure vibration for promoting discharge of droplets. The discharge pulse is applied to discharge droplets from the nozzles 101. The suppressing pulse is applied to control residual vibration.

The vibration pulse, the discharge pulse, and the suppressing pulse are square waves if a rise time and a fall time are ignored. However, the vibration pulse, the discharge pulse, and the suppressing pulse have a rise time and a fall time, and thus are waveforms similar to a trapezoid. Accordingly, it can be said that the vibration pulse, the discharge pulse, and the suppressing pulse are trapezoidal waves.

The drive waveform 51-1 includes one discharge pulse, the drive waveform 51-2 includes two continuous discharge pulses, . . . , and the drive waveform 51-7 includes seven continuous discharge pulses. For example, the drive waveform 51-7 illustrated in FIG. 11 includes a vibration pulse, first to seventh discharge pulses, and a suppressing pulse in this order. In addition, the drive waveform 51-2 includes a vibration pulse, first and second discharge pulses, and a suppressing pulse in this order. The drive waveform 51-1 includes a vibration pulse, a first discharge pulse, and a suppressing pulse in this order. Hereinafter, the initial discharge pulse among the continuous discharge pulses will be referred to as "initial discharge pulse". However, in the drive waveform including only one discharge pulse like the drive waveform 51-1, it is assumed that this discharge pulse is the initial discharge pulse. In addition, discharge pulses other than the initial discharge pulse will be referred to as "discharge pulses other than the initial discharge pulse". For example, in the drive waveform 51-7, second to seventh discharge pulses are the discharge pulses other than the initial discharge pulse, and the first discharge pulse is the initial discharge pulse.

The drive waveform 51 will be described in more detail using the drive waveform 51-2 as an example.

First, the drive circuit 103 starts application of the vibration pulse. The vibration pulse is a trapezoidal wave having an sp width in which the voltage changes in order of 0, −V1, and 0. The width represents the time from the start of the application of the pulse to the end of the application. Accordingly, the sp width represents that the time from the start of the application of the pulse to the end of the application is sp. Along with the start of the application of the vibration pulse, the voltage of the electrode 120*d* changes from 0 to −V1. The voltage of the electrode 120*d* is maintained at −V1 until the end of the application of the vibration pulse. The sum of the time in which the voltage of the electrode 120*d* falls from 0 to −V1 and the time in which the voltage of the electrode 120*d* is maintained at −V1 is the time sp.

Along with the start of the application of the vibration pulse, the volume of the pressure chamber 115*d* contracts such that liquid in the pressure chamber 115*d* is pressurized. The pressurization at the start of the application of vibration pulse is executed such that droplets are not discharged from the nozzles 101.

For the application of the vibration pulse, the voltage controller 32 controls, for example, the voltage switching unit 31 such that the first voltage source 40 and the wiring electrode 119*d* are connected to each other and the second voltage source 41 and the wiring electrodes 119*c* and 119*e* are connected to each other. As a result, as illustrated in FIG. 9, the volume of the pressure chamber 115*d* is contracted.

The drive circuit 103 ends the application of the vibration pulse after the predetermined time sp elapses from the start of the application of the vibration pulse. The drive circuit 103 starts the application of the first discharge pulse. The initial discharge pulse of the drive waveform 51-2 is, for example, a trapezoidal wave having a dpA width in which the voltage changes in order of 0, V1, and 0. Accordingly, the initial discharge pulse has a potential having a polarity opposite to the vibration pulse. Along with the end of the application of the vibration pulse and the start of the application of the discharge pulse, the voltage of the electrode 120*d* changes from −V1 to V1 through 0. The voltage of the electrode 120*d* is maintained at V1 until the end of the application of the first pulse. The sum of the time in which the voltage of the electrode 120*d* rises from 0 to V1 and the time in which the voltage of the electrode 120*d* is maintained at V1 is the time dpA.

Along with the end of the application of the vibration pulse and the start of the application of the first discharge pulse, the volume of the pressure chamber 115*d* expands such that liquid in the pressure chamber 115*d* is depressurized.

The drive circuit 103 ends the application of the first discharge pulse after the predetermined time dpA elapses from the start of the application of the first discharge pulse. Along with the end of the application of the discharge pulse, the voltage of the electrode 120*d* changes from V1 to 0. The voltage of the electrode 120*d* is maintained at 0 until the start of the application of the next pulse.

Along with the end of the application of the discharge pulse, the volume of the pressure chamber 115*d* contracts such that liquid in the pressure chamber 115*d* is pressurized. As a result, the liquid in the pressure chamber 115*d* is discharged as a droplet from the nozzles 101.

For the application of the discharge pulse, the voltage controller 32 controls, for example, the voltage switching unit 31 such that the second voltage source 41 and the wiring electrode 119*d* are connected to each other and the first voltage source 40 and the wiring electrodes 119*c* and 119*e* are connected to each other. As a result, as illustrated in FIG. 8, the volume of the pressure chamber 115*d* is expanded.

Due to the fall of the voltage from 0 to −V1 along with the start of the application of the vibration pulse and the rise of the voltage from −V1 to V1 along with the end of the application of the vibration pulse and the start of the application of the first discharge pulse, pressure vibration is generated in the liquid in the pressure chamber 115*d*. The voltage of the electrode 120*d* falls from the V1 to 0 along with the pressure vibration such that the discharge force of droplets can be improved. Therefore, by setting the time sp and the time dpA to be close to a half-period AL of the pressure vibration of the liquid in the pressure chamber 115, the discharge force of the first discharge pulse can be improved. In order to obtain a strong discharge force, by setting the time sp and the time dpA to be in a range of 0.5 AL to 1.5 AL such that the time sp and the time dpA match AL, the discharge force of the first discharge pulse can be maximized. The half-period AL of the pressure vibration is the time corresponding to half of the natural vibration period (a period of a main acoustic resonance frequency) of the liquid in the pressure chamber 115.

The first discharge pulse is an example of the first discharge pulse that causes liquid to be discharged from the nozzles 101.

Next, the drive circuit 103 starts the application of the second discharge pulse after a predetermined time elapses after the end of the application of the first discharge pulse. That is, the drive circuit 103 starts the application of the second discharge pulse such that the time from the center of the first discharge pulse to the center of the second discharge pulse is a predetermined time 2UL. The center of a pulse is an intermediate time point between the start of the application of the pulse and the end of the application. In the drive waveform 51-2, the second discharge pulse is a discharge pulse other than the initial discharge pulse. The discharge pulse other than the initial discharge pulse is, for example, a trapezoidal wave having a dpB width in which the voltage changes in order of 0, V1, and 0. Accordingly, the discharge pulse other than the initial discharge pulse has a potential having a polarity opposite to the vibration pulse. Along with the start of the application of the discharge pulse other than the initial discharge pulse, the voltage of the electrode 120*d* changes from 0 to V1. The voltage of the electrode 120*d* is maintained at V1 until the end of the application of the discharge pulse other than the initial discharge pulse. The sum of the time in which the voltage of the electrode 120*d* rises from 0 to V1 and the time in which the voltage of the electrode 120*d* is maintained at V1 is the time dpB.

By starting the application of the second discharge pulse to the vibration generated in the pressure chamber 115*d* by the first discharge pulse at an appropriate timing, the discharge force of the second discharge pulse can be improved. Accordingly, it is preferable that the time 2UL is 2AL.

The drive circuit 103 ends the application of the final discharge pulse after the predetermined time dpB elapses from the start of the application of the final discharge pulse. Along with the end of the application of the final discharge pulse, the voltage of the electrode 120*d* changes from V1 to 0. The voltage of the electrode 120*d* is maintained at 0 until the start of the application of the suppressing pulse. In order to obtain a strong discharge force, it is preferable that the time dpB is set to be in a range of 0.5 AL to 1.5 AL and the length of the time dpB is AL. The reason for this is that, by setting the length of the time dpB to be close to AL, the discharge force of the final discharge pulse can be improved.

Next, the drive circuit 103 starts the application of the suppressing pulse after a predetermined time elapses after the end of the application of the final discharge pulse. That is, the drive circuit 103 starts the application of the suppressing pulse such that the time from the center of the final discharge pulse to the center of the suppressing pulse is the predetermined time 2UL. The suppressing pulse is, for example, a trapezoidal wave having a cp width in which the voltage changes in order of 0, −V1, and 0. Along with the start of the application of the suppressing pulse, the voltage of the electrode 120*d* changes from 0 to −V1. The voltage of the electrode 120*d* is maintained at −V1 until the end of the application of the suppressing pulse. The sum of the time in which the voltage of the electrode 120*d* falls from 0 to −V1 and the time in which the voltage of the electrode 120*d* is maintained at −V1 is the time cp.

It is preferable that the time 2UL is 2AL. The reason for this is that, when the time 2UL is 2AL, vibration having a phase opposite to that of the vibration generated by the final discharge pulse is applied to the pressure chamber 115*d* by the suppressing pulse such that residual vibration in the pressure chamber 115*d* is suppressed. It is preferable that the length of the time cp is adjusted according to the degree of the residual vibration in the pressure chamber 115*d*.

Even in the case from the drive waveform 51-1 to the drive waveforms 51-3 to 51-7, the drive circuit 103 applies the drive waveform to the electrode 120*d* as in the case of the drive waveform 51-2. However, when the drive circuit 103 applies the drive waveform 51-1, the first discharge pulse is the final discharge pulse. Therefore, the suppressing pulse is applied after the first discharge pulse. In addition, the drive circuit 103 executes the application such that the time from the center of the n-th discharge pulse to the center of the (n+1)-th discharge pulse is 2UL. In this case, n represents an integer of 1 to 6.

By starting the application of the (n+1)-th discharge pulse to the vibration generated in the pressure chamber 115*d* by the n-th discharge pulse at an appropriate timing, the discharge force of the (n+1)-th discharge pulse can be improved. Accordingly, it is preferable that the time from the center of the n-th discharge pulse to the center of the (n+1)-th discharge pulse is 2AL. That is, it is preferable that the time 2UL is 2AL.

The second to sixth discharge pulses are examples of the second discharge pulse that is applied after the first discharge pulse and causes liquid to be discharged from the nozzles 101.

The electrode 120*d* is described above as a representative example. However, the description is also applicable to the electrodes 120*b*, 120*d*, 120*f*, and . . . .

As described above, in the liquid discharging unit 2, by changing the amount of droplets landed on one pixel based on the number of droplets continuously discharged to the image forming medium S, the gradation can be expressed. In the first embodiment, the gradation is expressed in 8 levels between 0 and 7. When droplets are landed on the image forming medium S while conveying the image forming medium S in a direction perpendicular to a discharging direction of the droplets, it is preferable that a deviation of the continuously discharged droplets from landing positions on the image forming medium S is small. In order to reduce this landing position deviation, it is preferable that a velocity of droplets that are subsequently discharged among the continuously discharged droplets is faster than or equal to a velocity of droplets that are previously discharged. In addition, even when a velocity of droplets that are finally discharged is extremely faster than a velocity of droplets that are initially discharged, the landing position deviation is large.

Accordingly, the velocity of droplets discharged by the drive waveform is adjusted.

First, the drive waveform 51-2 that causes two droplets to be continuously discharged is assumed. The pressure vibration generated in the pressure chamber 115 by the vibration pulse and the first discharge pulse is attenuated by the first droplet being discharged from the nozzles 101. In addition, the pressure vibration is attenuated by viscous resistance in the pressure chamber 115. Here, at a timing at which the time from the center of the first discharge pulse to the center of the second discharge pulse is the time 2UL, the second discharge pulse as the final discharge pulse is applied. As a result, the attenuation of the pressure vibration caused by the above-described factors can be compensated for. Thus, a discharge force for discharging the second droplet can be obtained. When the attenuation of the pressure vibration is the same as the addition of the pressure vibration by the second discharge pulse, the discharge velocities of the first droplet and the second droplet are substantially the same. That is, the second discharge pulse functions to maintain pressure vibration required to discharge the second droplet.

Here, for example, when the discharge velocity of the second droplet is slower than that of the first droplet although the width dpB of the second discharge pulse is AL, the width sp of the vibration pulse is adjusted to be more than or less than AL. When the viscosity of liquid to be discharged is high or when the flow path resistance of the pressure chamber 115 is high, this phenomenon is likely to occur. When the width sp of the vibration pulse is adjusted to be more than or less than AL, a phase of the pressure vibration generated in the pressure chamber 115 by the vibration pulse deviates from a phase of the pressure vibration generated in the pressure chamber 115 by the first pulse. Accordingly, by adjusting the width sp of the vibration pulse to be less than or more than AL, the discharge velocity of the first droplet can be made to be slower than that of a case where the width sp of the vibration pulse is AL.

In addition, by adjusting the width dpB of the second discharge pulse as the discharge pulse other than the initial discharge pulse to be less than or more than AL, the discharge velocity of the second droplet can be reduced. When the viscosity of liquid to be discharged is low or when the flow path resistance of the pressure chamber is low, and when the pulse width dpB is close to AL, the discharge velocity of the final droplet increases. As a result, the landing position deviation from a position where the first droplet lands on the medium S may be larger. Therefore, it is necessary to adjust the width dpB such that the discharge velocity of the final droplet is not excessively faster than the discharge velocity of the first droplet. From the viewpoint of reducing the voltage V1, it is preferable that the discharge force of the drive waveform is maximized by the discharge of the first droplet where residual vibration is not generated by the discharge of previous droplets. To that end, it is preferable that the width sp and the width dpA are values close to AL, and it is more preferable that the width sp and the width dpA match AL.

In addition, by adjusting the time 2UL from the center of the first discharge pulse to the center of the second discharge pulse to be less than or more than 2AL, the discharge velocity of the second droplet can be adjusted. In this case, in order to strengthen the pressure vibration generated in the pressure chamber 115 by the vibration pulse and the first discharge pulse with the pressure vibration generated by the second discharge pulse, it is preferable that the time 2UL is in a range of 1.5 AL to 2.5 AL. When the time 2UL is less than 1.5 AL or in a range of 2.5 AL to 3.5 AL, a phase of the pressure vibration generated by the second discharge pulse is opposite to a phase of the pressure vibration generated by the first discharge pulse. Therefore, the pressure vibration cannot be strengthened.

Next, the drive waveform 51-7 that causes seven droplets to be continuously discharged is assumed. Seven droplets are discharged from the nozzles 101 by each of the first to seventh discharge pulses at a timing at which the voltage falls from V1 to 0. Here, when the time 2UL is 2AL, a ratio (final droplet velocity/initial droplet velocity) of a velocity of droplets that are initially discharged to a velocity of droplets that are finally discharged is high.

As in the drive waveform 51-2, the second or subsequent discharge pulse of the drive waveform 51-7 functions to maintain pressure vibration required to discharge the second or subsequent droplet. If the flow path resistance in the ink jet head 10, for example, in the pressure chamber 115 is low due to the viscosity of liquid or a flow path structure, a discharge force applied to maintain pressure vibration required to discharge the second or subsequent droplet is reduced. Therefore, the width dpB is adjusted to be less than or more than AL. From the viewpoint of reducing the voltage V1, it is preferable that the width sp and the width dpA are values close to AL, and it is more preferable that the width sp and the width dpA match AL.

In addition, by adjusting the time 2UL to be less than or more than 2AL, the discharge velocity of the second or subsequent droplet can be adjusted. In this case, in order to strengthen residual vibration (pressure vibration) generated by the n-th discharge pulse with the pressure vibration generated by the (n+1)-th discharge pulse, it is preferable that the time 2UL is in a range of 1.5 AL to 2.5 AL.

In the drive waveform according to the embodiment, a discharge force is obtained by matching a phase of the residual vibration in the pressure chamber 115 to a phase of the discharge waveform. In addition, the amplitude of the residual vibration generated by the application of the drive waveform changes depending on the viscosity of liquid to be discharged, the flow path structure of the ink jet head, the material of the flow path of the ink jet head, and the like. Therefore, it is necessary to adjust a ratio between the respective waveform parameters such as the time sp, the time dpA, the time dpB, the time UL, and the time cp of the drive waveform according to the viscosity of the liquid, the kind of the ink jet head, and the like.

Examples

One embodiment for implementing the above-described embodiment will be described based on Examples. Examples are not limited to the range of the above-described embodiment.

In Examples, a simulation was performed by numerical analysis. A displacement generated in the actuator was calculated by structural analysis. In addition, the flow of fluid in the pressure chamber that underwent the displacement of the actuator was calculated by compressible flow analysis. The behavior of droplets discharged from the nozzles was calculated by surface flow analysis.

The range of the structural analysis will be described with reference to FIGS. 4 and 5. The range in a vertical direction of FIG. 5 was set as a range including the piezoelectric member 107 and the nozzle plate 109 that form the pressure chamber 115. The range in a horizontal direction of FIG. 5 was set as a range including the piezoelectric member 107 and the partition wall 111. The range in a vertical direction of FIG. 4 was set as a range from line A-A of the pressure chamber 115 to the air chamber 201 adjacent thereto. A boundary surface having a normal line in the vertical direction of FIG. 4 was set as a symmetrical boundary. In addition, the vertical direction of FIG. 4 is a depth direction of FIG. 5.

The range of the compressible flow analysis was set as a range including the pressure chamber. Regarding a boundary between the ink supply path and the ink discharge path and the pressure chamber, a free flow condition was set. A pressure value in the vicinity of the nozzle in the pressure chamber was input to surface flow analysis for analyzing a liquid surface of the nozzle. As a result, the flow rate of liquid flowing from the pressure chamber to the nozzle in the surface flow analysis was input to the compressible flow analysis as the flow rate of outflow in the vicinity of the nozzle in the pressure chamber. As a result, coupled analysis was performed.

In Examples, a simulation was conducted on a case where liquid having a viscosity of about 5 mPas and a specific gravity of about 0.85 was discharged in the ink jet head 10. AL of a simulation model of the inkjet head 10 according to Examples was about 2 μs.

Here, when the actuator is regarded as a capacitor and the internal resistance, wiring resistance, and other energy loss in the drive circuit 103 is regarded as resistance, a circuit that connects the voltage sources, the drive circuit 103, the wiring electrode 119, and the actuator can be regarded as an RC series circuit. A case where the voltage source is switched in the RC series circuit is assumed. The rise time and the fall time in each of the trapezoidal waves of the drive waveform correlate to a time constant of the RC circuit and shows the recharge time or the discharge time required for a voltage change in the capacitor when the voltage source connected to the capacitor is changed. In Examples, the drive waveform of the simulation model was set by setting the rise time and the fall time in each of the trapezoidal waves of the drive waveform 51 to be about 0.2 μs.

Numerical Analysis 1

In Numerical Analysis 1, a simulation was conducted on a case where the ink jet head 10 according to Examples discharged droplets using the drive waveform 51-5. At this time, the waveform parameters were set to be UL=AL, sp=0.8 AL, dpA=AL, cp=AL, and voltage V1=15 V. In addition, by performing the simulation while changing dpB in a range of 0.6 AL to 1.0 AL at an interval of 0.1 AL as shown in Table 1, the velocities of the first to fifth droplets in the case of each dpB were obtained. The results are shown in Table 1. When the droplets were coalesced halfway, the velocity of the coalesced droplet is shown in the column of the initial droplet velocity of the coalesced droplet. In addition, "←" is shown in the columns of the droplet velocities other than the initial droplet velocity of the coalesced droplet. Further, a ratio of the final droplet velocity to the initial droplet velocity is also shown. However, when all the first to fifth droplets were coalesced, "Coalesced" is shown instead of the velocity ratio.

TABLE 1

| Waveform Parameter | | | | | Droplet Velocity (m/s) after 70 μs | | | | | Final/ |
|---|---|---|---|---|---|---|---|---|---|---|
| UL | sp | dpA | dpB | cp | 1drop | 2drop | 3drop | 4drop | 5drop | Initial |
| AL | 0.8 AL | AL | 1.0 AL | AL | 13.39 | ← | ← | ← | 14.37 | 1.07 |
| AL | 0.8 AL | AL | 0.9 AL | AL | 13.48 | ← | ← | ← | ← | Coalesced |
| AL | 0.8 AL | AL | 0.8 AL | AL | 13.56 | ← | ← | ← | ← | Coalesced |
| AL | 0.8 AL | AL | 0.7 AL | AL | 13.04 | ← | ← | ← | 12.95 | 0.99 |
| AL | 0.8 AL | AL | 0.6 AL | AL | 12.33 | ← | ← | ← | 11.06 | 0.9 |

* "←" represents that the droplet coalesced with the previous droplet

It can be seen from Table 1 that all the droplets were coalesced under the condition of dpB=0.8 to 0.9 AL and the first to fourth droplets were not coalesced under the other conditions. Accordingly, it can be seen from Table 1 that, as the value of dpB becomes close to AL, the ratio of the final droplet velocity to the initial droplet velocity tends to increase. Therefore, it can be seen that the ratio of the final droplet velocity to the initial droplet velocity can be adjusted by adjusting the value of dpB.

In this example, one dot is formed on the image forming medium when five droplets discharged by the drive waveform 51-5 being landed on the image forming medium. Therefore, in order to prevent landing positions of the five droplets from being separated from each other on the image forming medium, it is preferable that the five droplets are coalesced or the final droplet velocity of the five droplets is faster than the initial droplet velocity. It can be seen from the above result that dpB among the waveform parameters shown in Table 1 is desirably set to be 0.8 AL or more.

Numerical Analysis 2

In Numerical Analysis 2, a simulation was conducted under the same conditions as those of Numerical Analysis 1, except that the value of sp was set as 0.9 AL. The results are shown in Table 2. In order to make pressure vibration generated when the voltage falls from V1 to V0 at the end edge of dpA and pressure vibration generated when the voltage falls from V0 to −V1 at the start edge of sp to have the same phase, it is only necessary that sp+0.2 μs=AL. Therefore, the value of sp was set as 0.9 AL.

TABLE 2

| Waveform Parameter | | | | | Droplet Velocity (m/s) after 70 μs | | | | | Final/ |
|---|---|---|---|---|---|---|---|---|---|---|
| UL | sp | dpA | dpB | cp | 1drop | 2drop | 3drop | 4drop | 5drop | Initial |
| AL | 0.9 AL | AL | 1.0 AL | AL | 14.09 | ← | ← | ← | ← | Coalesced |
| AL | 0.9 AL | AL | 0.9 AL | AL | 13.83 | ← | ← | ← | ← | Coalesced |
| AL | 0.9 AL | AL | 0.8 AL | AL | 14.17 | ← | ← | ← | 13.39 | 0.95 |
| AL | 0.9 AL | AL | 0.7 AL | AL | 13.7 | ← | ← | ← | ← | Coalesced |
| AL | 0.9 AL | AL | 0.6 AL | AL | 12.65 | ← | ← | ← | 11.79 | 0.93 |

* "←" represents that the droplet coalesced with the previous droplet

When droplets are continuously discharged, the respective droplets are connected immediately after the discharge. With the lapse of time, the set of droplets are separated depending on the action of surface tension, positions of bubbles included in the set of droplets, and the like. In addition, a separation position changes depending on the action of surface tension, positions of bubbles included in the set of droplets, and the like. In particular, droplets other than the initial droplet are likely to be affected by the action of surface tension and bubbles included in the set of droplets. As a result, a relationship between the initial droplet velocity and the final droplet velocity varies. It can be seen from the result of Table 2 that, as the value of dpB becomes close to AL, the ratio of the final droplet velocity to the initial droplet velocity tends to increase. In Numerical Analysis 2, the value of sp+0.2 μs is closer to AL than in Numerical Analysis 1. Therefore, it can be seen that the initial droplet velocity of Numerical Analysis 2 is faster than that of Numerical Analysis 1. Accordingly, it can be seen that, when the waveform parameters of Numerical analysis 2 are used, the same discharge velocity can be obtained at a lower voltage as compared to a case where the waveform parameters of Numerical analysis 1 are used. In the waveform parameters shown in Table 2, in order to adjust the final droplet velocity to be faster than the initial droplet velocity, it is only necessary to set dpB to 0.7 AL, 0.9 AL, or 1.0 AL. In addition, in order to make all the first to fifth droplets coalesce more reliably in consideration of the fact that the droplet velocity may vary to some extent due to manufacturing error of the ink jet head or the like, it is preferable that the value of dpB is 0.9 AL or more.

Here, in the ink jet head 10 driven by the drive waveform 51, a case where a nozzle 101 from which a different number of droplets are continuously discharged is present is assumed. For example, a case where five droplets are discharged from a nozzle 101*f* illustrated in FIG. 7 and one droplet is discharged from a nozzle 101*d* adjacent to the nozzle 101*f* is assumed. In order to reduce a difference between the time when the final droplet discharged from the nozzle 101*f* is landed on the image forming medium and the time when the droplet discharged from the nozzle 101*d* is landed on the image forming medium, it is preferable that a difference between the velocity of the droplet discharged by the drive waveform 51-1 and the velocity of the final droplet discharged by the drive waveform 51-5 is small. The velocity of the droplet discharged from the ink jet head 10 by the drive waveform 51-1 of the waveform parameters shown in Table 1 was about 7.1 m/s. In addition, the velocity of the droplet discharged from the ink jet head 10 by the drive waveform 51-1 of the waveform parameters shown in Table 2 was about 8.1 m/s. Accordingly, it can be seen that, with the waveform parameters shown in Table 2, the difference between the times of landing on the image forming medium is small under the condition that the final droplet velocity is faster than the initial droplet velocity.

Figure 12:
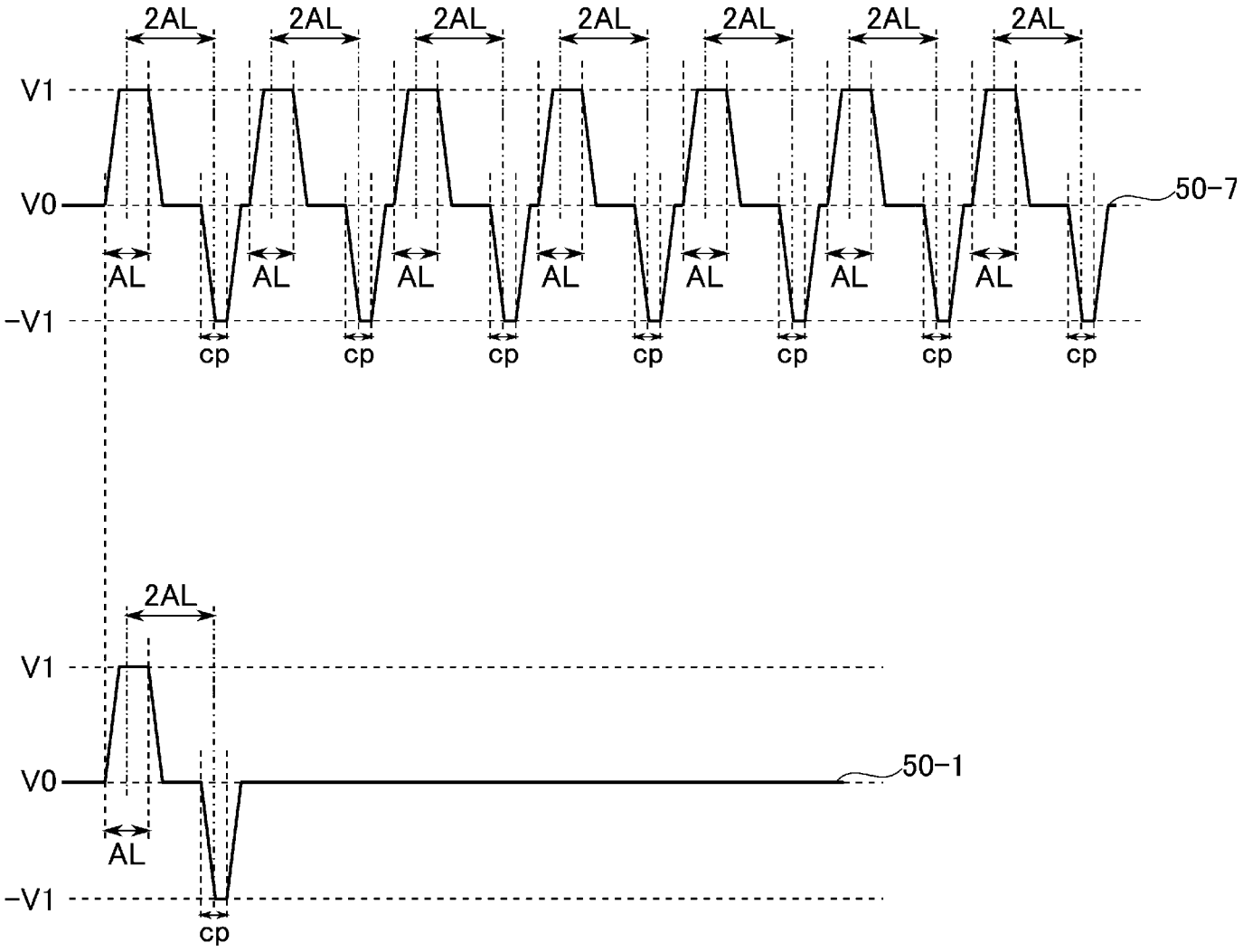
FIG. 12 is a diagram illustrating an example of a drive waveform of the related art.

FIG. 12 is a diagram illustrating an example of a drive waveform of the related art. A drive waveform 50-7 is an example of a drive waveform of the related art of a case where seven droplets are continuously discharged. A drive waveform 50-1 is an example of a drive waveform of the related art of a case where one droplet is continuously discharged. Drive waveforms 50-2 to 50-6 of cases where the numbers of droplets that are continuously discharged are 2 to 6 are not illustrated. The drive waveforms 50-1 to 50-7 will be collectively referred to as "drive waveform 50".

In the drive waveform 50 of the related art, as illustrated in the drive waveform 50-7, one droplet is discharged by a trapezoidal wave having a width AL at a voltage V1, and residual vibration in the pressure chamber is canceled out by a trapezoidal wave having a width cp at a voltage −V1 immediately after the voltage V1. In the drive waveform 50 of the related art, this process is repeated by the number of droplets that are continuously discharged.

Accordingly, in the ink jet head 10 according to the first embodiment, the time required to continuously discharge a plurality of droplets is shorter than that of the related art. That is, in the ink jet head 10 according to the first embodiment, the drive frequency is further improved as compared to the related art.

In the drive waveform 51-1, when sp=0.9 AL and the voltage is 15 V, the discharge velocity is about 8.1 m/s. On the other hand, in the drive waveform 50-1, when the discharge velocity of the droplet is about 8.1 m/s, the voltage V1 is 24.6 V.

Accordingly, in the ink jet head 10 according to the first embodiment, the voltage V1 can be further reduced as compared to the related art. That is, in the ink jet head 10 according to the first embodiment, the power consumption is lower than that of the related art.

The reason for this is that, in the drive waveform 51, the next discharge pulse is applied such that pressure vibration is strengthened by pressure vibration generated by a vibration pulse before the discharge of the droplet or pressure vibration generated when the droplet is discharged. As a result, an insufficient amount of discharge force for the discharge of the droplet is compensated for. On the other hand, in the drive waveform 50 illustrated in FIG. 12, pressure vibration is canceled out by a trapezoidal wave having a cp width every time one main droplet is discharged, and it is necessary to secure a discharge force required to discharge the droplet using only a trapezoidal wave having an AL width. As a result, the voltage V1 of the drive waveform 50 is much higher than the voltage value shown in Table 2.

As described above, a circuit that connects the voltage sources, the drive circuit, the wiring electrode, and the actuator can be regarded as an RC series circuit. The power consumption of the RC series circuit is proportional to the number of trapezoidal waves (pulses) and the square of the voltage. When the number of continuously discharged droplets is 5, the number of trapezoidal waves of the drive waveform 50-5 is 10, and the number of trapezoidal waves of the drive waveform 51-5 is 7. When the power consumptions of the drive waveform 50-5 and the drive waveform 51-5 are compared to each other under the condition of "sp=0.9 AL", the power consumption of the drive waveform 51-5 is 26% of the power consumption of the drive waveform 50-5 and can be reduced by 70% or higher.

In addition, the ink jet head 10 according to the first embodiment operates using the two voltage sources including the first voltage source 40 and the second voltage source 41. This way, the ink jet head 10 can operate using a small number of voltage sources. Therefore, the ink jet head 10 according to the first embodiment can be manufactured at a lower cost than that of the related art.

In the inkjet head 10 according to the first embodiment, the number of coalesced main droplets can be reduced. Accordingly, the ink jet head 10 according to the first embodiment can further improve the image quality as compared to the related art.

When liquid having a low viscosity is discharged, the final droplet velocity may be excessively fast. In this case, even when all the droplets are coalesced, the landing accuracy of the droplet may be low. The ink jet head 10 according to the first embodiment can prevent the final droplet velocity from becoming excessively fast, and thus is suitable for a case where liquid having a low viscosity is discharged.

Second Embodiment

A configuration of the ink jet recording apparatus 1 according to a second embodiment is the same as described above using FIGS. 1 to 6 of the first embodiment. Accordingly, the description of the corresponding portion will not be repeated.

Figure 13:
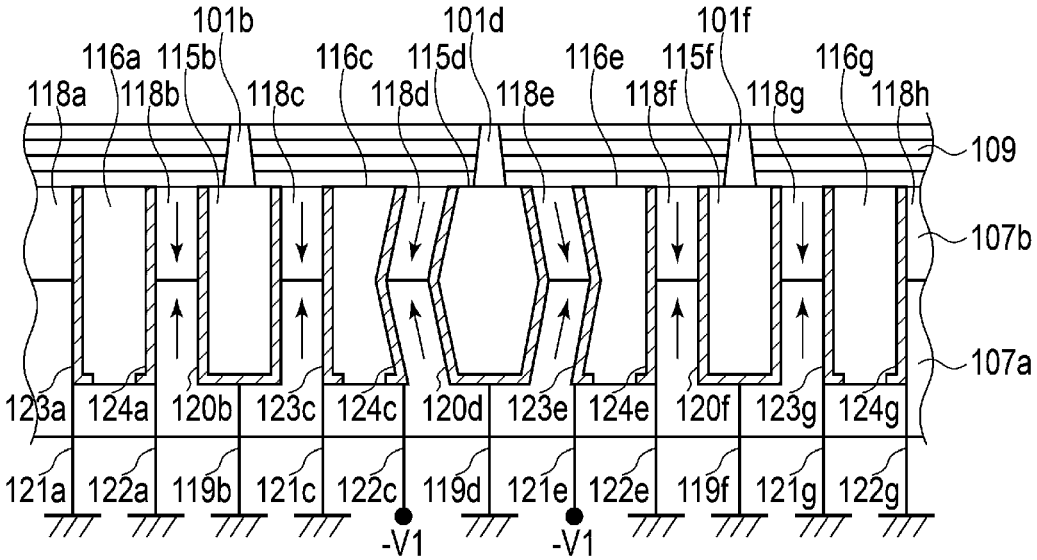
FIG. 13 is a diagram illustrating a state where one pressure chamber is expanded.
Figure 14:
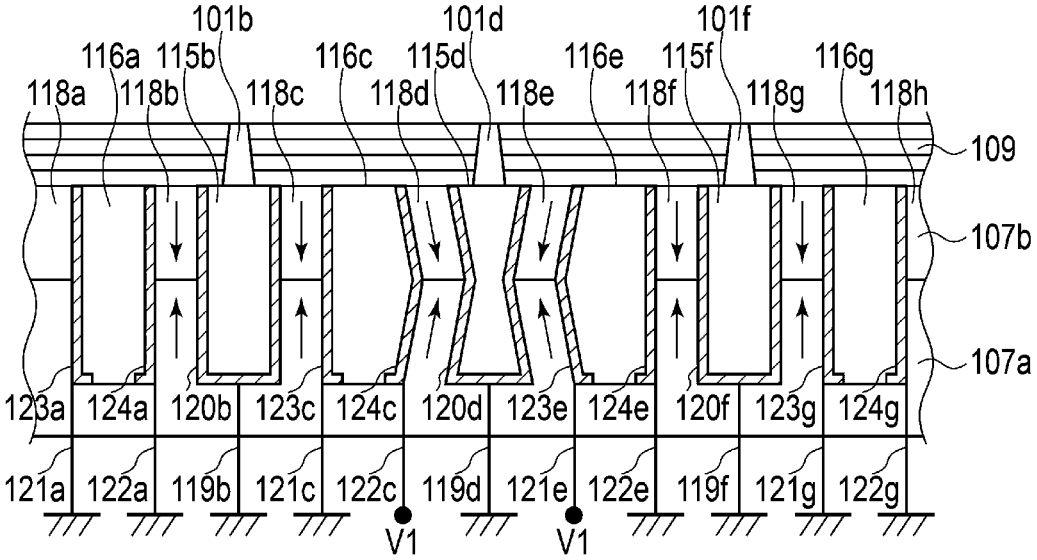
FIG. 14 is a diagram illustrating a state where one pressure chamber is contracted.

However, in the ink jet recording apparatus 1 according to the second embodiment, as illustrated in FIGS. 13 and 14, electrodes 123 and 124 are formed on the piezoelectric member inner surface of the air chamber instead of the electrodes 120. FIGS. 13 and 14 are diagrams illustrating states of the pressure chamber. The electrodes 123 and 124 are divided, for example, in the bottom of a slot and are electrically separated. In addition, in the piezoelectric member 107, wiring electrodes 121 (121*a*, 121*c*, 121*e*, . . . ) and wiring electrodes 122 (122*a*, 122*c*, 122*e*, . . . ) are formed instead of the wiring electrodes 119*a*, 119*c*, 119*e*, . . . . The wiring electrode 121 electrically connects the electrode 123 and a drive circuit 103*b* to each other. The wiring electrode 122 electrically connects the electrode 124 and the drive circuit 103*b* to each other. The drive circuit 103*b* will be described below.

Figure 15:
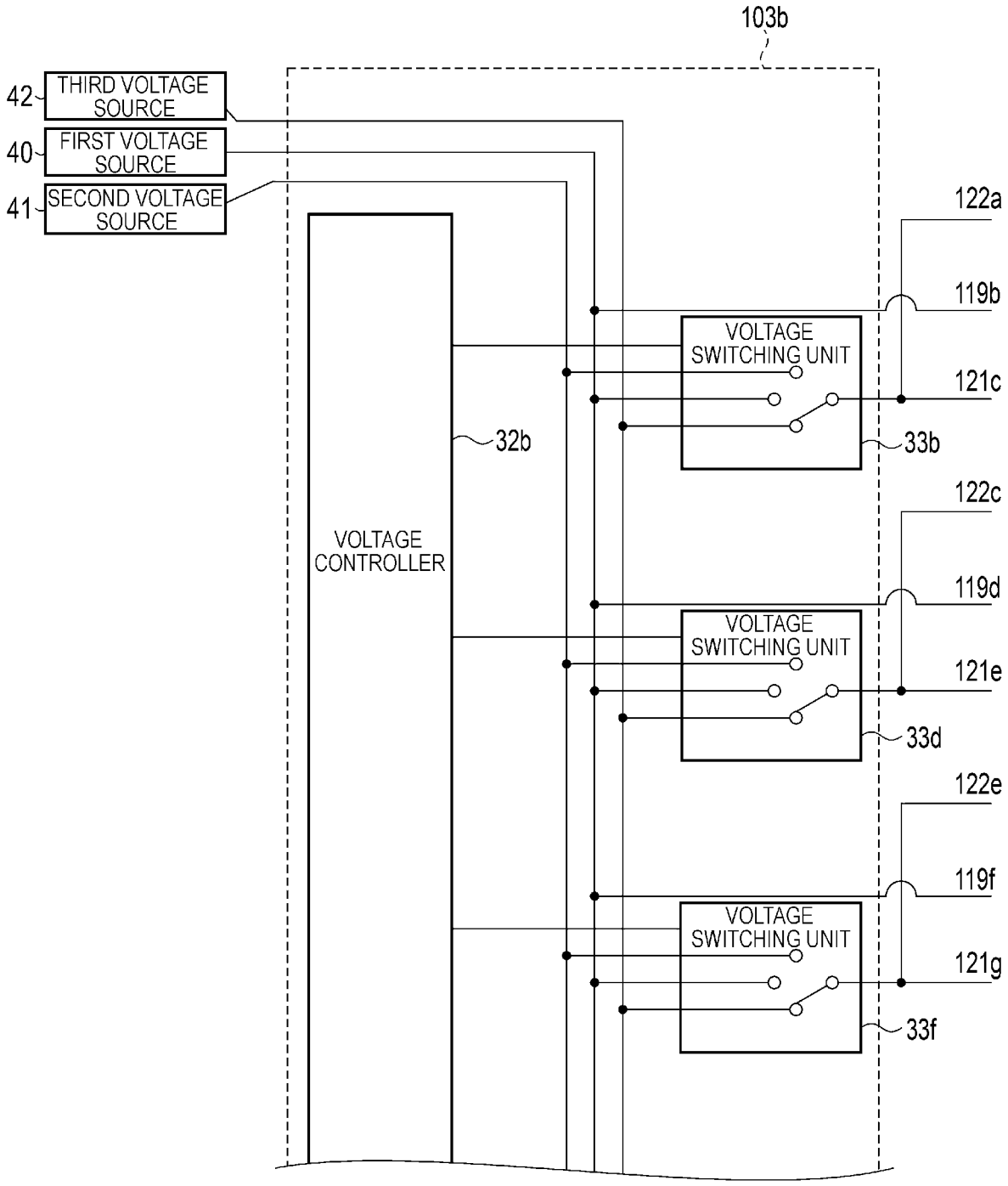
FIG. 15 is a diagram illustrating a configuration example of a drive circuit according to the second embodiment.

The ink jet recording apparatus 1 according to the second embodiment includes the drive circuit 103*b* illustrated in FIG. 15 instead of the drive circuit 103 illustrated in FIG. 10. FIG. 15 is a diagram illustrating a configuration example of the drive circuit 103*b*. The drive circuit 103*b* includes a voltage controller 32*b*. The drive circuit 103*b* includes a number of voltage switching units 33 corresponding to the number of the pressure chambers 115 in the ink jet head 10. FIG. 15 illustrate voltage switching unit 33*b*, 33*d*, and 33*f* as the voltage switching units 33 and does not illustrate a voltage switching unit 33*h* and thereafter.

The drive circuit 103*b* is connected to the first voltage source 40, the second voltage source 41, and a third voltage source 42. The drive circuit 103*b* selectively applies voltages supplied from the first voltage source 40, the second voltage source 41, and the third voltage source 42 to the respective wiring electrodes 121 and 122. The voltage value of the output voltage of the third voltage source 42 is −V1.

Under the control of the voltage controller 32*b*, the voltage switching unit 33*b* connects any one of the first voltage source 40, the second voltage source 41, or the third voltage source 42 to the wiring electrodes 122*a* and 121*c*. Under the control of the voltage controller 32*b*, the voltage switching unit 33*d* connects any one of the first voltage source 40, the second voltage source 41, or the third voltage source 42 to the wiring electrodes 122*c* and 121*e*. Under the control of the voltage controller 32*b*, the voltage switching unit 33*f* connects any one of the first voltage source 40, the second voltage source 41, or the third voltage source 42 to the wiring electrodes 122*e* and 121*g*. The description is applicable to the voltage switching units 33*h*, 33*j*, and . . . . In addition, the wiring electrodes 119*b*, 119*d*, and . . . are connected to the first voltage source 40. Accordingly, the electrodes 120*b*, 120*d*, and . . . of the inner wall of the pressure chamber are connected to the first voltage source 40 through the wiring electrodes 119*b*, 119*d*, and . . . .

In an example illustrated in FIG. 15, the wiring electrode 119 connected to the electrode 120 of the pressure chamber inner wall is connected to the first voltage source 40 in the drive circuit 103*b*. However, this wiring electrode may be connected to the first voltage source 40 in a portion outside the drive circuit. In this case, the wiring electrode connected to the drive circuit is connected to only the electrode of the air chamber inner wall.

The third voltage source 42 is an example of the third voltage source. The drive circuit 103*b* is an example of the application unit.

In the drive circuit 103*b* according to the second embodiment, the drive circuit 103*b* causes the pressure chamber to be in a state illustrated in FIG. 13 instead of the drive circuit 103 according to the first embodiment causing the pressure chamber to be in the state illustrated in FIG. 8.

In FIG. 13, the volume of the pressure chamber 115*d* is expanded.

FIG. 13 illustrates the head substrate 102 in a state where the voltage applied to the electrodes 124*c* and 123*e* is set as the voltage −V1 and the voltage applied to the other electrodes 120, 123, and 124 is set as a ground voltage.

In the drive circuit 103*b* according to the second embodiment, the drive circuit 103*b* causes the pressure chamber to be in a state illustrated in FIG. 14 instead of the drive circuit 103 according to the first embodiment causing the pressure chamber to be in the state illustrated in FIG. 9.

In FIG. 14, the volume of the pressure chamber 115*d* is contracted. In FIG. 14, the actuators 118*d* and 118*e* are deformed in a shape opposite to the state illustrated in FIG. 13.

FIG. 14 illustrates the head substrate 102 in a state where the voltage applied to the electrodes 124*c* and 123*e* is set as the voltage V1 and the voltage applied to the other electrodes 120, 123, and 124 is set as a ground voltage. In the state illustrated in FIG. 14, a potential difference having a polarity opposite to that of FIG. 13 is generated between the electrode 120*d* and the electrodes 124*c* and 123*e* present at opposite ends of the electrode 120*d*. Due to the potential difference, the actuators 118*d* and 118*e* undergoes shearing deformation in a shape opposite to that of FIG. 13.

In the actuator 118*d* illustrated in FIGS. 13 and 14, the electrode 120*d* is an example of the first electrode. In the actuator 118*d* illustrated in FIGS. 13 and 14, the electrode 124*c* is an example of the second electrode. In the actuator 118*e* illustrated in FIGS. 13 and 14, the electrode 120*d* is an example of the first electrode. In the actuator 118*e* illustrated in FIGS. 13 and 14, the electrode 123*e* is an example of the second electrode. Each of the other actuators 118 also includes the first electrode and the second electrode.

When the vibration pulse or the suppressing pulse is input to the pressure chamber 115*d* communicating with the nozzle 101*d* illustrated in FIG. 13, the drive circuit 103*b* applies the voltage V1 to the electrodes 124*c* and 123*e* as illustrated in FIG. 14. Here, the deformation state of the adjacent pressure chamber 115*f* is determined depending on the voltage applied to the electrodes 124*e* and 123*g*. Accordingly, the drive circuit 103*b* can input the vibration pulse or the suppressing pulse to the adjacent pressure chamber 115*d*, for example, while the discharge pulse is being input to the pressure chamber 115*f*. Therefore, as illustrated in FIG. 16, the start of the application of the drive waveform for continuously discharging one to six droplets can be advanced as compared to the first embodiment.

Figure 16:
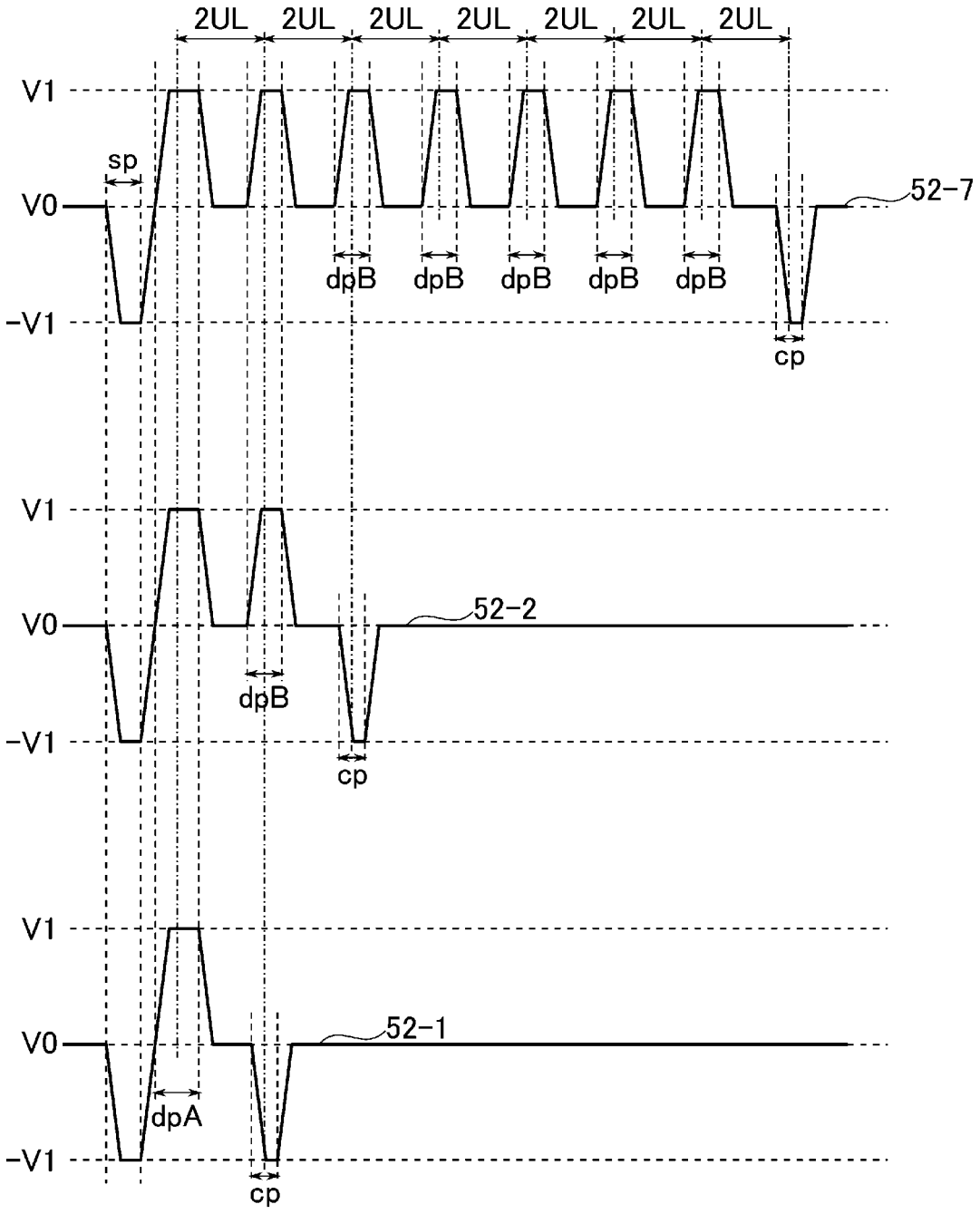
FIG. 16 is a diagram illustrating an example of a drive waveform according to the second embodiment.

FIG. 16 is a diagram illustrating a drive waveform example of a drive signal that is output from the drive circuit 103*b*. A drive waveform 52-7 is a drive waveform of a case where the number of droplets that are continuously discharged is 7. A drive waveform 52-2 is a drive waveform of a case where the number of droplets that are continuously discharged is 2. A drive waveform 52-1 is a drive waveform of a case where the number of droplets that are continuously discharged is 1. Drive waveforms 52-3 to 52-6 of cases where the numbers of droplets that are continuously discharged are 3 to 6 are not illustrated. The drive waveforms 52-1 to 52-7 will be collectively referred to as "drive waveform 52". In FIG. 16, the horizontal axis represents the time, and the vertical axis represents a voltage. The voltage is a voltage relative to voltages adjacent to the electrode 120 of the inner wall of the pressure chamber 115. In this case, the voltage is the voltage of the electrode 120 relative to reference voltages that are the voltages of the electrodes 124 and 123 on the pressure chamber 115 side in the air chambers adjacent to the pressure chamber 115. For example, the voltage is the voltage of the electrode 120*d* relative to the voltages of the electrodes 124*c* and 123*e*. For example, when the drive circuit 103*b* applies the voltage −V1 to the electrodes 124*c* and 123*e*, the voltage of the electrode 120*d* is V1 relative to the voltages of the electrodes 124*c* and 123*e*.

Regarding a plurality of nozzles in a nozzle array of the inkjet head 10 driven by the drive waveform 52 illustrated in FIG. 16, a case where a nozzle from which a different number of droplets are continuously discharged is present is assumed. For example, a case where seven droplets are discharged from a nozzle 101*f* illustrated in FIG. 7 and one droplet is discharged from a nozzle 101*d* adjacent to the nozzle 101*f* is assumed. As can be seen from the drive waveforms 52-7 and 52-1 of FIG. 16, a waveform up to the first discharge pulse in the drive waveform 52-7 and a waveform up to the first discharge pulse in the drive waveform 52-1 are the same. Therefore, a difference between the discharge velocities of the initial droplets discharged from both the nozzles 101*f* and 101*d* is small.

As in the first embodiment, the inkjet head 10 according to the second embodiment can improve the drive frequency and can reduce the power consumption. In addition, as in the first embodiment, the ink jet head 10 according to the second embodiment is suitable for a case where liquid having a low viscosity is discharged.

In addition, as described above, the ink jet head 10 according to the second embodiment can advance the start of the application of the drive waveform as compared to the first embodiment. Accordingly, in the ink jet head 10 according to the second embodiment, even when seven droplets are continuously discharged, waveform parameters that promote the droplets to coalesce can be selected, and the landing position deviation of the continuously discharged seven droplets can be reduced.

In the ink jet head 10 according to the second embodiment, the electrode 120 in contact with the liquid I is connected to the first voltage source 40 having a ground voltage. In the ink jet head 10 according to the second embodiment, a positive or negative voltage is applied to the electrode 123 or 124 that is not in contact with the liquid I. Accordingly, the ink jet head 10 according to the second embodiment can be drive without applying a voltage to the electrode 120 of the inner wall of the pressure chamber 115 in contact with the liquid I. As a result, a potential difference is not generated in the liquid I. Therefore, the ink jet head 10 according to the second embodiment can discharge even liquid that causes an electrochemical reaction to occur such that properties are likely to change without changing the properties.

The embodiments can also be modified as follows.

The ink jet recording apparatus 1 according to the embodiment is an ink jet printer that forms a two-dimensional image on the image forming medium S using ink. However, the inkjet recording apparatus according to the embodiment is not limited to the ink jet printer. The ink jet recording apparatus according to the embodiment may be, for example, a 3D printer, an industrial manufacturing machine, or a medical machine. When the ink jet recording apparatus according to the embodiment is a 3D printer, an industrial manufacturing machine, or a medical machine, the ink jet recording apparatus according to the embodiment forms a three-dimensional object by discharging a material as a raw material or a binder for bonding a material from the ink jet head.

The ink jet recording apparatus 1 according to the embodiment includes four liquid discharging units 2, and the color of the liquid I used in each of the liquid discharging units 2 is cyan, magenta, yellow, or black. However, the number of the liquid discharging units 2 included in the ink jet recording apparatus is not limited to 4 and is not necessarily plural. In addition, the color, properties, and the like of the liquid I used in each of the liquid discharging units 2 are not limited.

In addition, the liquid discharging unit 2 can discharge transparent gloss ink, ink that develops color when irradiated with infrared light, ultraviolet light, or the like, or other special inks. Further, the liquid discharging unit 2 may discharge liquid other than ink. The liquid that is discharged by the liquid discharging unit 2 may be a dispersion such as a suspension. Examples of the liquid other than ink that is discharged by the liquid discharging unit 2 include a liquid including conductive particles for forming a wiring pattern of a printed wiring board, a liquid including cells or the like for artificially forming a tissue or an organ, a binder such as an adhesive, wax, and, a liquid resin.

Other than in the operating examples, if any, or where otherwise indicated, all numbers, values and/or expressions referring to parameters, measurements, conditions, etc., used in the specification and claims are to be understood as modified in all instances by the term "about."

Each of the numerical values in the embodiments includes errors within the scope of the embodiments.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head, comprising:

a pressure chamber accommodating liquid;

an actuator configured to change a volume of the pressure chamber in accordance with a drive signal applied to the actuator; and an application unit configured to apply the drive signal to the actuator, the drive signal including:

a first discharge pulse that causes liquid to be discharged from a nozzle communicating with the pressure chamber;

a second discharge pulse that is applied after the first discharge pulse and causes liquid to be discharged from the nozzle communicating with the pressure chamber; and a vibration pulse that is applied before the first discharge pulse and has a potential difference having a polarity opposite to that of the first discharge pulse and the second discharge pulse, and causes a pressure vibration to be generated in the liquid to promote discharge of the liquid during at least one of the first discharge pulse and the second discharge pulse, characterized in that a period (2UL) between a center of the first discharge pulse and a center of the second discharge pulse is 1.5 times to 2.5 times a half-period (AL) of a main acoustic resonance frequency of the liquid in the pressure chamber, and a pulse width (dpA) of the first discharge pulse is closer to the half-period of the main acoustic resonance frequency of the liquid in the pressure chamber than a pulse width (dpB) of the second discharge pulse, the pulse width of the first discharge pulse being a sum of a time in which a voltage of the first discharge pulse rises from 0 to V1 and a time in which the voltage of the first discharge pulse is maintained at V1, and the pulse width of the second discharge pulse being a sum of a time in which a voltage of the second discharge pulse rises from 0 to V1 and a time in which the voltage of the second discharge pulse is maintained at V1.

2. The ink jet head according to claim 1, wherein the actuator includes a first electrode and a second electrode, and the application unit is further configured to:

apply the first discharge pulse and the second discharge pulse to the actuator by connecting a second voltage source to the first electrode and connecting a first voltage source to the second electrode; and apply the vibration pulse to the actuator by connecting the first voltage source to the first electrode and connecting the second voltage source to the second electrode.

3. The ink jet head according to claim 1, wherein the actuator includes a first electrode and a second electrode, and the application unit is further configured to:

apply the first discharge pulse and the second discharge pulse to the actuator by connecting the first electrode to a first voltage source and connecting a second voltage source to the second electrode; and apply the vibration pulse to the actuator by connecting the first electrode to the first voltage source and connecting the second voltage source to the second electrode.

4. The ink jet head according to claim 1, wherein the vibration pulse has a width such that a velocity at which droplets are discharged by the second discharge pulse that is finally applied among the second discharge pulses included in the drive signal is faster than or equal to a velocity at which droplets are discharged by the first discharge pulse.

5. The ink jet head according to claim 1, wherein the actuator comprises two electrodes.

6. The ink jet head according to claim 1, wherein the actuator comprises a piezoelectric element.

7. An ink jet recording apparatus, comprising:

an ink jet head; and an ink supply device configured to supply liquid to the ink jet head, the ink jet head including:

a pressure chamber accommodating liquid;

an actuator configured to change a volume of the pressure chamber in accordance with a drive signal to be applied; and an application unit configured to apply the drive signal to the actuator, the drive signal includes:

a first discharge pulse that causes liquid to be discharged from a nozzle communicating with the pressure chamber;

a second discharge pulse that is applied after the first discharge pulse and at which liquid is discharged from the nozzle communicating with the pressure chamber; and a vibration pulse that is applied before the first discharge pulse and has a potential difference having a polarity opposite to that of the first discharge pulse and the second discharge pulse, and causes a pressure vibration to be generated in the liquid to promote discharge of the liquid during at least one of the first discharge pulse and the second discharge pulse, characterized in that a period (2UL) between a center of the first discharge pulse and a center of the second discharge pulse is 1.5 times to 2.5 times a half-period (AL) of a main acoustic resonance frequency of the liquid in the pressure chamber, and a pulse width (dpA) of the first discharge pulse is closer to the half-period of the main acoustic resonance frequency than a pulse width (dpB) of the second discharge pulse, the pulse width of the first discharge pulse being a sum of a time in which a voltage of the first discharge pulse rises from 0 to V1 and a time in which the voltage of the first discharge pulse is maintained at V1, and the pulse width of the second discharge pulse being a sum of a time in which a voltage of the second discharge pulse rises from 0 to V1 and a time in which the voltage of the second discharge pulse is maintained at V1.

8. The ink jet recording apparatus according to claim 7, wherein the actuator includes a first electrode and a second electrode, and the application unit is further configured to:

apply the first discharge pulse and the second discharge pulse to the actuator by connecting a second voltage source to the first electrode and connecting a first voltage source to the second electrode; and apply the vibration pulse to the actuator by connecting the first voltage source to the first electrode and connecting the second voltage source to the second electrode.

9. The ink jet recording apparatus according to claim 7, wherein the actuator includes a first electrode and a second electrode, and the application unit is further configured to:

apply the first discharge pulse and the second discharge pulse to the actuator by connecting the first electrode to a first voltage source and connecting a second voltage source to the second electrode; and apply the vibration pulse to the actuator by connecting the first electrode to the first voltage source and connecting the second voltage source to the second electrode.

10. The ink jet recording apparatus according to claim 7, wherein the vibration pulse has a width such that a velocity at which droplets are discharged by the second discharge pulse that is finally applied among the second discharge pulses included in the drive signal is faster than or equal to a velocity at which droplets are discharged by the first discharge pulse.

11. The ink jet recording apparatus according to claim 7, wherein the actuator comprises two electrodes.

12. The ink jet recording apparatus according to claim 7, wherein the actuator comprises a piezoelectric element.

13. The ink jet recording apparatus according to claim 7, wherein the ink jet recording apparatus is an inkjet printer, a 3D printer, an industrial manufacturing machine, or a medical machine.

14. The ink jet recording apparatus according to claim 7, comprising:

a plurality of ink supply devices each configured to supply a different colored liquid to the ink jet head.

15. A method, comprising:

changing a volume of a pressure chamber in accordance with a drive signal applied to an actuator; and applying the drive signal to the actuator, comprising:

providing a first discharge pulse that causes liquid to be discharged from a nozzle communicating with the pressure chamber;

providing a second discharge pulse that is applied after the first discharge pulse and causes liquid to be discharged from the nozzle communicating with the pressure chamber; and providing a vibration pulse that is applied before the first discharge pulse and has a potential difference having a polarity opposite to that of the first discharge pulse and the second discharge pulse, and causes a pressure vibration to be generated in the liquid to promote discharge of the liquid during at least one of the first discharge pulse and the second discharge pulse, characterized in that a period (2UL) between a center of the first discharge pulse and a center of the second discharge pulse is 1.5 times to 2.5 times a half-period (AL) of a main acoustic resonance frequency of the liquid in the pressure chamber, and a pulse width (dpA) of the first discharge pulse is closer to the half-period of the main acoustic resonance frequency than a pulse width (dpB) of the second discharge pulse, the pulse width of the first discharge pulse being a sum of a time in which a voltage of the first discharge pulse rises from 0 to V1 and a time in which the voltage of the first discharge pulse is maintained at V1, and the pulse width of the second discharge pulse being a sum of a time in which a voltage of the second discharge pulse rises from 0 to V1 and a time in which the voltage of the second discharge pulse is maintained at V1.

16. The method according to claim 15, further comprising:

providing the first discharge pulse and the second discharge pulse to the actuator by connecting a second voltage source to a first electrode and connecting a first voltage source to a second electrode; and providing the vibration pulse to the actuator by connecting the first voltage source to the first electrode and connecting the second voltage source to the second electrode.

17. The method according to claim 15, further comprising:

providing the first discharge pulse and the second discharge pulse to the actuator by connecting a first electrode to a first voltage source and connecting a second voltage source to a second electrode; and providing the vibration pulse to the actuator by connecting the first electrode to the first voltage source and connecting a second voltage source to the second electrode.

18. The method according to claim 15, wherein the vibration pulse has a width such that a velocity at which droplets are discharged by the second discharge pulse that is finally applied among the second discharge pulses included in the drive signal is faster than or equal to a velocity at which droplets are discharged by the first discharge pulse.

* * * * *